US008063293B1

(12) United States Patent
Kjellgren

(10) Patent No.: US 8,063,293 B1
(45) Date of Patent: Nov. 22, 2011

(54) DRUM PEDAL SYSTEMS

(76) Inventor: Goran L. Kjellgren, Flagstaff, AZ (US)

( * ) Notice: Subject to any disclaimer, the term of this patent is extended or adjusted under 35 U.S.C. 154(b) by 0 days.

(21) Appl. No.: 12/545,792

(22) Filed: Aug. 21, 2009

Related U.S. Application Data

(63) Continuation-in-part of application No. 12/109,205, filed on Apr. 24, 2008, now abandoned, which is a continuation-in-part of application No. 11/203,455, filed on Aug. 12, 2005, now abandoned.

(60) Provisional application No. 61/178,602, filed on May 15, 2009, provisional application No. 61/173,162, filed on Apr. 27, 2009, provisional application No. 61/165,850, filed on Apr. 1, 2009, provisional application No. 61/154,320, filed on Feb. 20, 2009.

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS

| | | | | |
|---|---|---|---|---|
| 3,030,847 | A * | 4/1962 | Thompson | 84/422.1 |
| 3,195,391 | A * | 7/1965 | Peters | 84/422.1 |
| 3,316,792 | A * | 5/1967 | Ippolito | 84/422.1 |
| 3,426,640 | A * | 2/1969 | Slingerland, Jr. | 84/422.1 |
| 3,439,574 | A * | 4/1969 | Ramsey | 84/422.1 |
| 3,930,431 | A * | 1/1976 | Magadini | 84/422.1 |
| 4,756,224 | A * | 7/1988 | Lombardi | 84/422.1 |
| 4,958,549 | A * | 9/1990 | Vukovic | 84/422.1 |
| 5,388,494 | A * | 2/1995 | Hoshino | 84/422.1 |
| 5,398,584 | A * | 3/1995 | Liao | 84/422.1 |
| 5,945,616 | A | 8/1999 | Hoshino | |
| 6,063,993 | A * | 5/2000 | Hoshino | 84/422.1 |
| 6,150,596 | A | 11/2000 | Hsieh | |
| 6,255,574 | B1 | 7/2001 | Sapienza | |
| 6,331,666 | B1 | 12/2001 | Chang | |
| 6,359,205 | B1 * | 3/2002 | Lombardi | 84/422.1 |
| 6,392,130 | B1 | 5/2002 | Carlson | |
| 6,399,866 | B2 | 6/2002 | Tanaka | |
| 6,570,076 | B1 * | 5/2003 | Kjellgren | 84/422.1 |
| 6,590,147 | B2 | 7/2003 | Kassabian | |
| 6,689,945 | B1 * | 2/2004 | Matsuzoe et al. | 84/422.1 |
| 6,765,141 | B2 | 7/2004 | Shigenaga | |
| 6,894,210 | B1 | 5/2005 | Lombardi | |
| 7,122,730 | B2 | 10/2006 | Takegawa | |
| 7,297,852 | B1 | 11/2007 | Chen | |
| 7,396,986 | B2 | 7/2008 | Packer | |
| 7,399,916 | B1 | 7/2008 | Lombardi | |
| 7,405,352 | B2 * | 7/2008 | Dorfman et al. | 84/422.1 |
| 7,456,351 | B2 | 11/2008 | Dorfman et al. | |
| 7,511,212 | B1 | 3/2009 | Chang | |
| 7,550,663 | B2 * | 6/2009 | Lin | 84/422.1 |
| 7,579,539 | B2 * | 8/2009 | Chen | 84/422.1 |
| 7,579,540 | B2 * | 8/2009 | Takegawa | 84/422.1 |
| 7,601,902 | B1 * | 10/2009 | Lombardi | 84/422.1 |
| 7,663,041 | B1 * | 2/2010 | Lin | 84/422.1 |
| 7,671,262 | B1 * | 3/2010 | Lin | 84/422.1 |
| 7,696,422 | B1 * | 4/2010 | Chang | 84/422.1 |

(Continued)

*Primary Examiner* — Elvin G Enad
*Assistant Examiner* — Robert W Horn
(74) *Attorney, Agent, or Firm* — Stoneman Law Patent Group; Martin L. Stoneman

(57) ABSTRACT

A user-adjustable drum pedal having foot-pedal geometries corresponding to the biomechanical requirements of a user. Preferred embodiments of the system utilize an adjustable foot pedal in combination with a laterally movable drum beater drive assembly functioning to maintain proper mechanical geometries within the operating apparatus. The angular position of the foot pedal is selectable by the user.

22 Claims, 20 Drawing Sheets

U.S. PATENT DOCUMENTS

2007/0044637 A1 3/2007 Kjellgren
2008/0173159 A1 7/2008 Chen
2008/0196574 A1* 8/2008 Kjellgren ..... 84/422.1
2008/0282868 A1 11/2008 Lin

* cited by examiner

FIG. 21
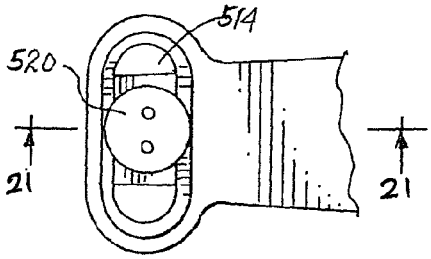
FIG. 20
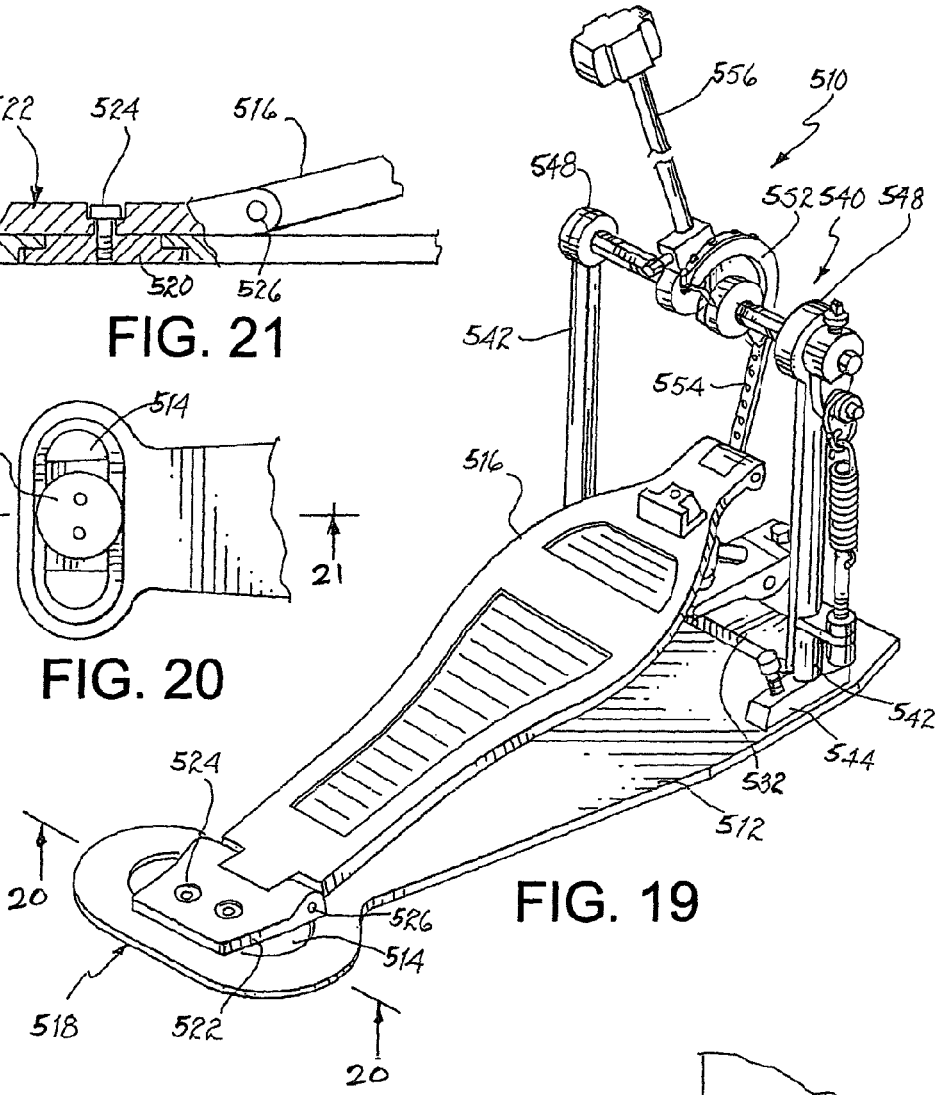
FIG. 19
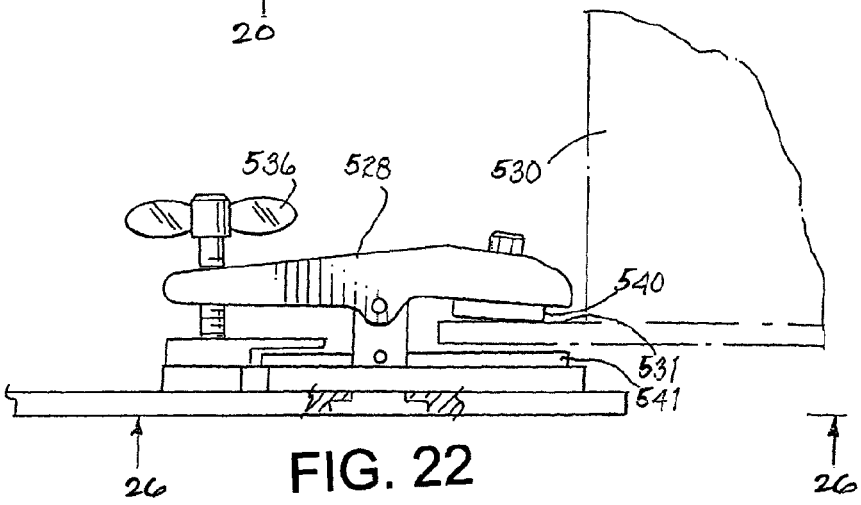
FIG. 22

DRUM PEDAL SYSTEMS

CROSS-REFERENCE TO RELATED APPLICATION

The present application is related to and claims priority from prior U.S. Provisional Patent Application Ser. No. 61/178,602, filed May 15, 2009, entitled "Drum Pedal Systems", and is related to and claims priority from prior U.S. Provisional Patent Application Ser. No. 61/173,162, filed Apr. 27, 2009, entitled "DRUM PEDAL SYSTEMS", and is related to and claims priority from Prior U.S. Provisional Patent Application Ser. No. 61/165,850, filed Apr. 1, 2009, entitled "DRUM PEDAL SYSTEMS", and is related to and claims priority from Prior U.S. Provisional Application Ser. No. 61/154,320, filed Feb. 20, 2009, entitled "DRUM PEDAL SYSTEMS", the contents of all of which are incorporated herein by this reference and are not admitted to be prior art with respect to the present invention by the mention in this cross-reference section.

The present application is also a continuation-in-part of related U.S. patent application Ser. No. 12/109,205, filed Apr. 24, 2008, entitled "ADJUSTABLE DRUM PEDAL AND METHOD THEREFOR", which is a continuation-in-part of related U.S. patent application Ser. No. 11/203,455 filed Aug. 12, 2005, entitled "ADJUSTABLE DRUM PEDAL AND METHOD THEREFOR", the contents of both of which are also incorporated herein by this reference and are not admitted to be prior art with respect to the present invention by the mention in this cross-reference section.

BACKGROUND

This invention relates to providing a drum-pedal system for improving the comfort and convenience of bass drum players. More particularly, this invention relates to providing a system for providing drum pedals adjusted or adjustable to the ergonomic requirements of a specific percussion player.

Bass drums may be played using a foot-actuated mallet or "beater ball" customarily operated by a depressible foot pedal. When the foot pedal is depressed, a mechanical drive train may be activated that results in the beater ball moving through an arc to strike the bass drum. When pressure may be removed from the pedal, the pedal is released allowing the beater ball to return to a resting position ready to move forward again to strike the drum when the foot pedal is depressed again.

The bodies of different individuals vary in size, proportion, and biomechanical geometry. Most people have minor variations in bone alignment and joint mobility when compared to anthropometric averages. Some individuals have more significant variations that may be expressed as a tendency to have in-toeing or out-toeing foot positions. As most percussion music is inherently repetitious, it is important to establish a biomechanically correct playing position corresponding to the physical characteristics of an individual percussionist.

Therefore, a need exists for adjustable or pre-adjusted drum pedals that address the above mentioned issues.

OBJECTS AND FEATURES OF THE INVENTION

A primary object and feature of the present invention is to provide a system addressing the above-mentioned needs. A further object and feature of the present invention is to provide such a system that comprises preferred pedal embodiments having foot-pedal geometries corresponding to the biomechanical requirements of the user. Another object and feature of the present invention is to provide such a system that utilizes a pivoting foot pedal in combination with a laterally movable drum beater functioning to maintain proper mechanical geometries within the operating assembly.

A further primary object and feature of the present invention is to provide such a system that is efficient, inexpensive, and useful. Other objects and features of this invention preferably become apparent with reference to the following descriptions.

SUMMARY OF THE INVENTION

In accordance with a preferred embodiment hereof, this invention provides a drum-pedal system related to foot-actuated playing of at least one drum by at least one drum player, such drum-pedal system comprising, in combination: at least one foot pedal, having at least one toe-end portion and at least one heel-end portion, such at least one foot pedal structured and arranged to receive at least one foot of the at least one drum player; at least one hinge structured and arranged to hingedly couple such at least one heel-end portion with such at least one toe-end portion to enable up-and-down movement of such at least one toe-end portion about at least one first rotational axis; at least one rotatable support bar structured and arranged to provide rotatable-bar support about at least one second rotational axis; at least one positioning frame structured and arranged to position such at least one rotatable support bar adjacent such at least one toe-end portion; a pivot structured and arranged to provide side-to-side pivoting of such at least one toe-end portion about a third rotational axis intersecting such at least one heel-end portion and oriented substantially perpendicular to such at least one first rotational axis; coupled with such at least one rotatable support bar, at least one drum-striker structured and arranged to strike the at least one drum on rotation of such at least one rotatable support bar; and at least one bar rotator structured and arranged to rotate such at least one rotatable support bar when pressure is applied to such at least one toe-end portion; wherein such at least one bar rotator is mounted to such at least one rotatable support bar to allow lateral movement of such at least one bar rotator, in at least one direction substantially parallel with such at least one second rotational axis, in coordination with such side-to-side pivoting of such at least one toe-end portion about such second rotational axis.

Moreover, it provides such a drum-pedal system wherein the position of such pivot relative to is at least adjustable along at least one line oriented substantially parallel with such at least one second rotational axis. Additionally, it provides such a drum-pedal system wherein the location of such pivot is fixed relative to such at least one positioning frame. Also, it provides such a drum-pedal system further comprising at least one striker-return assembly structured and arranged to return such at least one drum-striker to at least one starting position when pressure is removed from the at least one foot pedal. In addition, it provides such a drum-pedal system wherein such at least one positioning frame comprises at least one coupling device structured and arranged to couple such at least one positioning frame to the at least one drum. And, it provides such a drum-pedal system wherein such at least at least one coupling device comprises at least one clamping device structured and arranged to provide clamp-assisted coupling of such at least one positioning frame to the at least one drum. Further, it provides such a drum-pedal system wherein such at least one drum-striker and such at least one clamping device are each alignable to at least one position of intersection with a substantially vertical plane passing through such pivot and oriented substantially perpendicular to such at least one second rotational axis. Even further, it provides such a drum-pedal system wherein: the relative positions of such at least one drum-striker, such at least one clamping device, and such pivot are positionally fixed within such at least one positioning frame; and such at least one drum-striker, such at least one clamping device, and such pivot are each geometrically aligned to intersect a substantially vertical plane oriented substantially perpendicular to such at least one second rotational axis.

Moreover, it provides such a drum-pedal system wherein such at least one positioning frame comprises at least one base support structured and arranged to support such at least one positioning frame on at least one supportive surface. Additionally, it provides such a drum-pedal system wherein such at least one bar rotator comprises: releasably coupled to such at least one rotatable support bar, at least one torque arm structured and arranged to induce a rotation of such at least one first rotatable support bar by the application of at least one torque-arm force; and at least one linkage structured and arranged to operably link such at least one torque arm with such at least one toe-end portion; wherein such at least one torque arm comprises at least one lateral adjuster structured and arranged allow lateral adjustment to the position of at least one torque arm, in at least one direction substantially parallel with such at least one second rotational axis; wherein such at least one linkage comprises at least one first coupler structured and arrange to couple a first end portion of such at least one linkage to such at least one toe-end portion, and at least one second coupler structured and arrange couple a second end portion of such at least one linkage to such at least one torque arm.

Also, it provides such a drum-pedal system wherein such at least one first coupler comprises at least one spherical bearing structured and arranged to permit angular rotation of such at least one linkage about at least one central connection point. In addition, it provides such a drum-pedal system wherein such at least one first striker-return assembly comprises at least one spring structured and arranged to generate at least one biasing force having at least one first end coupled with such at least one positioning frame and at least one second end eccentrically coupled with such at least one rotatable support bar. And, it provides such a drum-pedal system wherein such at least one positioning frame further comprises projecting generally upwardly from such at least one base support, a single support column structured and arranged to support such at least one first rotatable support bar in at least one substantially horizontal position adjacent such at least one toe-end portion.

Further, it provides such a drum-pedal system wherein such at least one positioning frame further comprises: projecting generally upwardly from such at least one base support, a single support column structured and arranged to support such at least one first rotatable support bar in at least one substantially horizontal position at an elevation above such at least one toe-end portion wherein such single support column comprises at least one friction-reducing bearing structured and arranged to provide reduced-friction rotation of such at least one first rotatable support bar during such support; wherein such at least one first rotatable support bar is arranged to passes through such single support column; wherein such at least one drum-striker is mounted to such at least one first rotatable support bar on a first side of such single support column; wherein such at least one torque arm is mounted to such at least one first rotatable support bar on a second side of such single support column.

Even further, it provides such a drum-pedal system wherein such at least one positioning frame further comprises: projecting generally upwardly from such at least one base support, at least two support columns structured and arranged to support such at least one first rotatable support bar in at least one substantially horizontal position at an elevation above such at least one toe-end portion; wherein each such at least two support columns comprise at least one friction-reducing bearing structured and arranged to provide reduced-friction rotation of such at least one first rotatable support bar during such support. Moreover, it provides such a drum-pedal system further comprising: at least one additional rotatable support bar structured and arranged to provide rotatable-bar support about such at least one second rotational axis; coupled with such at least one additional rotatable support bar at least one additional drum-striker structured and arranged to be independently actuatable by at least one additional rotation-generating torque force; and at least one additional striker-return assembly structured and arranged to return such at least one additional drum-striker to at least one starting position when such at least one additional rotation-generating torque force is removed from such at least one additional rotatable support bar; wherein such at least one bar rotator is positioned to the right of such at least one drum-striker and such at least one additional drum-striker.

Additionally, it provides such a drum-pedal system further comprising: at least one additional foot-actuated pedal assembly structured and arranged to generate such at least one additional rotation-generating torque force when pressure is applied to at least one additional foot pedal of such at least one additional foot-actuated pedal assembly; and at least one force-transfer linkage structured and arranged to transfer such at least one additional rotation-generating torque force to such at least one additional rotatable support bar. Also, it provides such a drum-pedal system wherein such at least one force-transfer linkage comprises at least one angular adjuster structured and arranged to allow user-selected angular adjustments of such at least one additional foot-actuated pedal relative to such at least one additional rotatable support bar.

In accordance with another preferred embodiment hereof, this invention provides a drum-pedal system related to assisting ergonomically correct foot placement during foot-actuated playing of at least one drum by at least one drum player, such drum-pedal system comprising, in combination: at least one foot pedal, having at least one toe-end portion, at least one heel-end portion and at least one longitudinal axis extending therebetween, such at least one foot pedal structured and arranged to receive at least one foot of the at least one drum player; at least one hinge structured and arranged to hingedly couple such at least one heel-end portion with such at least one toe-end portion to enable up-and-down movement of such at least one toe-end portion about at least one first rotational axis; at least one rotatable support bar structured and arranged to provide rotatable-bar support about at least one second rotational axis; at least one positioning frame structured and arranged to position such at least one rotatable support bar adjacent such at least one toe-end portion; at least one clamping device structured and arranged to provide clamp-assisted coupling of such at least one positioning frame to the at least one drum; coupled with such at least one rotatable support bar, at least one drum-striker structured and arranged to strike the at least one drum on rotation of such at least one rotatable support bar; at least one bar rotator structured and arranged to rotate such at least one rotatable support bar when pressure is applied to such at least one toe-end portion; and at least one pedal mount structured and arranged to rigidly mount such at least one heel-end portion to such at least one positioning frame; wherein the relative positions of such at least one clamping device and such at least one heel-end portion are positionally fixed within such at least one positioning frame; wherein such at least one longitudinal axis comprises a fixed acute angle relative to substantially vertical plane.

In addition, it provides such a drum-pedal system wherein such fixed acute angle is oriented to the right of such substantially vertical plane. And, it provides such a drum-pedal system wherein such fixed acute angle is oriented to the left of such substantially vertical plane. Further, it provides such a drum-pedal system wherein such fixed acute angle comprises an angle measurement of between about one degree and about forty-five degrees. Even further, it provides such a drum-pedal system wherein such at least one drum-striker, such at least one clamping device, and such at least one heel-end portion are each geometrically aligned to intersect a substantially vertical plane oriented substantially perpendicular to such at least one second rotational axis.

In accordance with another preferred embodiment hereof, this invention provides a drum-pedal system related to establishing an ergonomically correct foot placement, on at least one foot-actuated drum pedal assembly, by at least one drum player during foot-actuated playing of at least one drum, such at least one foot-actuated drum pedal assembly comprising: at least one foot-actuatable pedal; at least one rotatable support bar; at least one drum-striker structured and arranged to strike the at least one drum on rotation of such at least one rotatable support bar about a horizontal axis of rotation; and at least one laterally-adjustable bar rotator adapted to rotate such at least one rotatable support bar about the horizontal axis of rotation when pressure is applied to such at least one foot-actuatable pedal; wherein such at least one foot-actuatable pedal comprises at least one adjuster to assist adjustment of such at least one foot-actuatable pedal to at least one selected angular orientation, relative to the horizontal axis of rotation, by rotating at least one toe-end portion of such at least one foot pedal about at least one pivot point of at least one heel-end portion of such at least one foot-actuatable pedal; wherein such at least one first adjuster comprises at least one releasable lock to releasably lock such at least one foot-actuatable pedal in the at least one selected angular orientation, wherein such at least one toe-end portion, when locked, comprises a fixed geometrical relationship with such at least one rotatable support bar; and wherein such at least one laterally-adjustable bar rotator is adjustable to at least one operable position associated with such fixed geometrical relationship. Moreover, it provides such a drum-pedal system wherein such at least one foot-actuatable pedal further comprises: at least one second adjuster to assist positional adjustment of such at least one foot-actuatable pedal relative to the horizontal axis of rotation; wherein such positional is along at least one line oriented substantially parallel to such horizontal axis of rotation.

In accordance with another preferred embodiment hereof, this invention provides a method related to establishing an ergonomically correct foot placement, on at least one foot-actuated drum pedal assembly, by at least one drum player during foot-actuated playing of at least one drum, such at least one foot-actuated drum pedal assembly comprising at least one foot pedal, at least one rotatable support bar, at least one drum-striker structured and arranged to strike the at least one drum on rotation of the at least one rotatable support bar about a horizontal axis of rotation, and at least one laterally-adjustable bar rotator adapted to rotate the at least one rotatable support bar about the horizontal axis of rotation when pressure is applied to the at least one foot pedal, such method comprising the steps of: adjusting the at least one foot pedal to at least one selected angular orientation, relative to the horizontal axis of rotation, by rotating at least one toe-end portion of the at least one foot pedal about a pivot point of at least one heel-end portion of the at least one foot pedal; fixing the at least one foot pedal in the at least one selected angular orientation, wherein the at least one toe-end portion comprises a fixed geometrical relationship with the at least one rotatable support bar; adjusting the at least one laterally-adjustable bar rotator to at least one operable position associated with such fixed geometrical relationship.

In accordance with another preferred embodiment hereof, this invention provides an adjustable drum pedal comprising, in combination: at least one foot pedal; at least one base plate; at least one frame coupled to such at least one base plate; at least one support bar having at least one slot running at least one length of such at least one support bar coupled to such at least one frame and raised above such at least one base plate; at least one drum-beater mechanism movably coupled to such at least one frame to allow at least one user to adjust at least one position of such at least one drum-beater mechanism on such at least one frame; at least one drive assembly movably coupled to such at least one drum-beater mechanism and such at least one foot pedal structured and arranged to move such at least one drum-beater mechanism when pressure is applied to such at least one foot pedal and return such at least one drum-beater mechanism to at least one starting position when such pressure is removed from such at least one foot pedal; and at least one adjustment device, having at least one first end coupled to such at least one foot pedal and at least one second end slidably coupled in such at least one slot of such at least one support bar to assist adjusting at least one position of such at least one foot pedal relative to such at least one base plate.

Additionally, it provides such an adjustable drum pedal wherein such at least one adjustment device comprises: at least one foot-pedal tab hingedly coupled to such at least one foot pedal structured and arranged to allow such at least one foot pedal to pivot in a substantially up-and-down motion; and at least one bar member having at least one first end coupled to such at least one foot pedal tab and at least one second end slidably coupled in such at least one slot of such at least one support bar. Also, it provides such an adjustable drum pedal further comprising: at least one clamping device movably coupled to such at least one base plate structured and arranged to allow the at least one user to couple such at least one adjustable drum pedal in multiple positions relative to at least one drum; at least one second slot running along at least one width of at least one top section of such at least one base plate; and at least one clamping-device adjustment mechanism, position in aid at least one second slot and coupled to such at least one clamping device, structured and arranged to allow such at least one clamping device to move within such at least one second slot.

In addition, it provides such an adjustable drum pedal wherein such at least one frame comprises: at least one pair of support bars; coupled to such at least one base plate and such at least one pair of support bars, base members structured and arranged to couple at least one support bar of such at least one pair to such at least one base plate; and at least one cross bar rotatably coupled to such at least one support bar of such at least one pair. And, it provides such an adjustable drum pedal wherein such at least one drive assembly comprises: at least one wheel device coupled to such at least one frame; at least one cord coupled to such at least one wheel device and to such at least one foot pedal; and end couplers coupled to at least one first end and at least one second end of such at least one cord to secure such at least one cord to such at least one wheel device and such at least one foot pedal. Further, it provides such an adjustable drum pedal wherein such at least one wheel device comprises at least one channel, such at least one cord positioned to rest in such at least one channel, at least one of such end couplers coupling such at least one cord to such at least one channel of such at least one wheel device.

Even further, it provides such an adjustable drum pedal wherein such at least one drive assembly further comprises at least one spring device coupled to such at least one frame to return such at least one drum-beater mechanism to at least one starting position when pressure is removed from such at least one foot pedal. Even further, it provides such an adjustable drum pedal wherein such at least one spring device further comprises: end couplers coupled to at least one first end and at least one second end of such at least one spring device; and at least one ring member coupled to each end coupler to allow such at least one spring device to rotate when such at least one foot pedal is depressed and released.

In accordance with another preferred embodiment hereof, this invention provides an adjustable drum pedal comprising, in combination: at least one foot pedal; at least one base plate, wherein such at least one base plate is shorter than such at least one foot pedal; at least one frame coupled to such at least one base plate; coupled to such at least one frame and raised above aid at least one base plate, at least one support bar comprising at least one slot running at least one length of such at least one support bar; at least one drum beater mechanism movably coupled to such at least one frame to allow at least one user adjust at least one position of such at least one drum beater mechanism on such at least one frame; at least one drive assembly movably coupled to such at least one drum-beater mechanism and such at least one foot pedal structured and arranged to move such at least one drum-beater mechanism when pressure is applied to such at least one foot pedal and return such at least one drum-beater mechanism to at least one starting position when pressure is removed from such at least one foot pedal; at least one clamping device movably coupled to such at least one base plate structured and arranged to allow the at least one user couple such at least one adjustable drum pedal in multiple positions relative to at least one drum; at least one foot-pedal tab hingedly coupled to such at least one foot pedal structured and arranged to allow such at least one foot pedal to pivot in a substantially up-and-down motion; and at least one bar member having at least one first end coupled to such at least one foot-pedal tab and at least one second end slidably coupled in such at least one slot of such at least one support bar for adjusting at least one position of such at least one foot pedal relative to such at least one base plate.

Even further, it provides such an adjustable drum pedal further comprising: at least one second slot running along at least one width of at least one top section of such at least one base plate; and at least one clamping-device adjustment mechanism positioned in such at least one second slot and coupled to such at least one clamping device to allow such at least one clamping device to move within such at least one second slot. Even further, it provides such an adjustable drum pedal wherein such at least one frame comprises: at least one pair of support bars; base members coupled to such at least one base plate and such at least one pair of support bars to couple such at least one support bars to such base plate; and at least one cross bar rotatably coupled to at least one support bar of such at least one pair of support bars.

Furthermore, it provides such an adjustable drum pedal wherein the drive assembly comprises: at least one wheel device coupled to such at least one frame; at least one cord coupled to such at least one wheel device and to such at least one foot pedal; and end couplers coupled to at least one first end and at least one second end of such at least one cord to secure such at least one cord to such at least one wheel device and such at least one foot pedal. Even further, it provides such an adjustable drum pedal wherein such at least one wheel device comprises at least one channel, such at least one cord positioned to rest in such at least one channel, one of such at least one end couplers coupling such at least one cord to such at least one channel in such at least one wheel device.

Even further, it provides such an adjustable drum pedal wherein such at least one drive assembly further comprises, coupled to such at least one frame, at least one spring device structured and arranged to return such at least one drum-beater mechanism to at least one starting position when pressure is removed from such at least one foot pedal. Even further, it provides such an adjustable drum pedal wherein aid at least one spring device further comprises: end couplers coupled to at least one first end and at least one second end of such at least one spring device; and at least one ring member coupled to each end coupler to allow such at least one spring device to rotate when such at least one foot pedal is depressed and released.

In accordance with another preferred embodiment hereof, this invention provides an adjustable drum pedal comprising, in combination: at least one foot pedal; at least one base plate; at least one frame coupled to such at least one base plate; coupled to such at least one frame and raised above such at least one base plate, at least one support bar comprising at least one slot running at least one length of such at least one support bar; at least one drum-beater mechanism movably coupled to such at least one frame to allow at least one user to adjust at least one position of such at least one drum-beater mechanism on such at least one frame, wherein such at least one drive assembly comprises: at least one wheel device coupled to such at least one frame; at least one cord coupled to aid at least one wheel device and to such at least one foot pedal; and end couplers coupled to at least one first end and at least one second end of such at least one cord to secure such at least one cord to such at least one wheel device and such at least one foot pedal; at least one drive assembly movably coupled to such at least one drum-beater mechanism and such at least one foot pedal structured and arranged to move such at least one drum-beater mechanism when pressure is applied to such at least one foot pedal and return such drum beater mechanism to a starting position when pressure is removed from such at least foot pedal; at least one clamping device movably coupled to such at least one base plate to allow at least one user couple such at least one adjustable drum pedal in multiple positions relative to at least one drum; and at least one foot-pedal tab hingedly coupled to such at least one foot pedal to allow such at least one foot pedal to pivot in an up-and-down motion; and at least one bar member having at least one first end coupled to such at least one foot-pedal tab and at least one second end slidably coupled in such at least one slot of such at least one support bar for adjusting at least one position of such at least one foot pedal relative to such at least one base plate.

Moreover, it provides such an adjustable drum pedal further comprising: at least one second slot running along at least one width of at least one top section of such at least one base plate; and at least one clamping-device adjustment mechanism positioned in such at least one second slot and coupled to such at least one clamping device to allow such at least one clamping device to move within such at least one second slot. Even further, it provides such an adjustable drum pedal wherein such at least one wheel device comprises at least one channel, such at least one cord positioned to rest in such at least one channel, one of such end couplers coupling such at least one cord to such at least one channel of such at least one wheel device.

Furthermore, it provides such an adjustable drum pedal wherein such at least one drive assembly further comprises at least one spring device coupled to such at least one frame to return such at least one drum beater mechanism to at least one starting position when pressure is removed from such at least one foot pedal. Even further, it provides such an adjustable drum pedal wherein such at least one spring device further comprises: end couplers coupled to at least one first end and at least one second end of such at least one spring device; and at least one ring member coupled to each such end coupler to allow such at least one spring device to rotate when such at least one foot pedal is depressed and released.

In accordance with another preferred embodiment hereof, this invention provides a drum-pedal system related to establishing an ergonomically correct foot placement, on at least one foot-actuated drum pedal assembly, by at least one drum player during foot-actuated playing of at least one drum, such at least one foot-actuated drum pedal assembly comprising: at least one foot-actuatable pedal; at least one rotatable support bar; at least one drum-striker structured and arranged to strike the at least one drum on rotation of such at least one rotatable support bar; at least one positionally-adjustable bar rotator adapted to rotate such at least one rotatable support bar when pressure is applied to such at least one foot-actuatable pedal; wherein the relative orientations of such at least one positionally-adjustable bar rotator and such at least one foot-actuatable pedal are adjustable to accommodate at least one preferred playing position of the at least one drum player; and wherein such at least one positionally-adjustable bar rotator and such at least one foot-actuatable pedal are operably coupled by at least one linkage comprising at least one spherical bearing structured and arranged to accommodate divergent angular positioning between such at least one positionally-adjustable bar rotator and such at least one foot-actuatable pedal. In accordance with another preferred embodiment hereof, this invention provides each and every novel feature, element, combination, step and/or method disclosed or suggested by this patent application.

BRIEF DESCRIPTION OF THE DRAWINGS

FIG. 19 shows an elevated perspective view of another preferred embodiment of an adjustable drum pedal of the present invention.

FIG. 20 shows a partial bottom view of the rear section of the base plate used in the adjustable drum pedal depicted in FIG. 19.

FIG. 21 shows a cross sectional side view of the adjustable drum pedal taken along lines 21-21 of FIG. 20.

FIG. 22 shows a side view of the adjustable drum clamp used in the adjustable drum pedal of FIG. 19.

DETAILED DESCRIPTION OF THE BEST MODES AND PREFERRED EMBODIMENTS OF THE INVENTION

Figure 1:
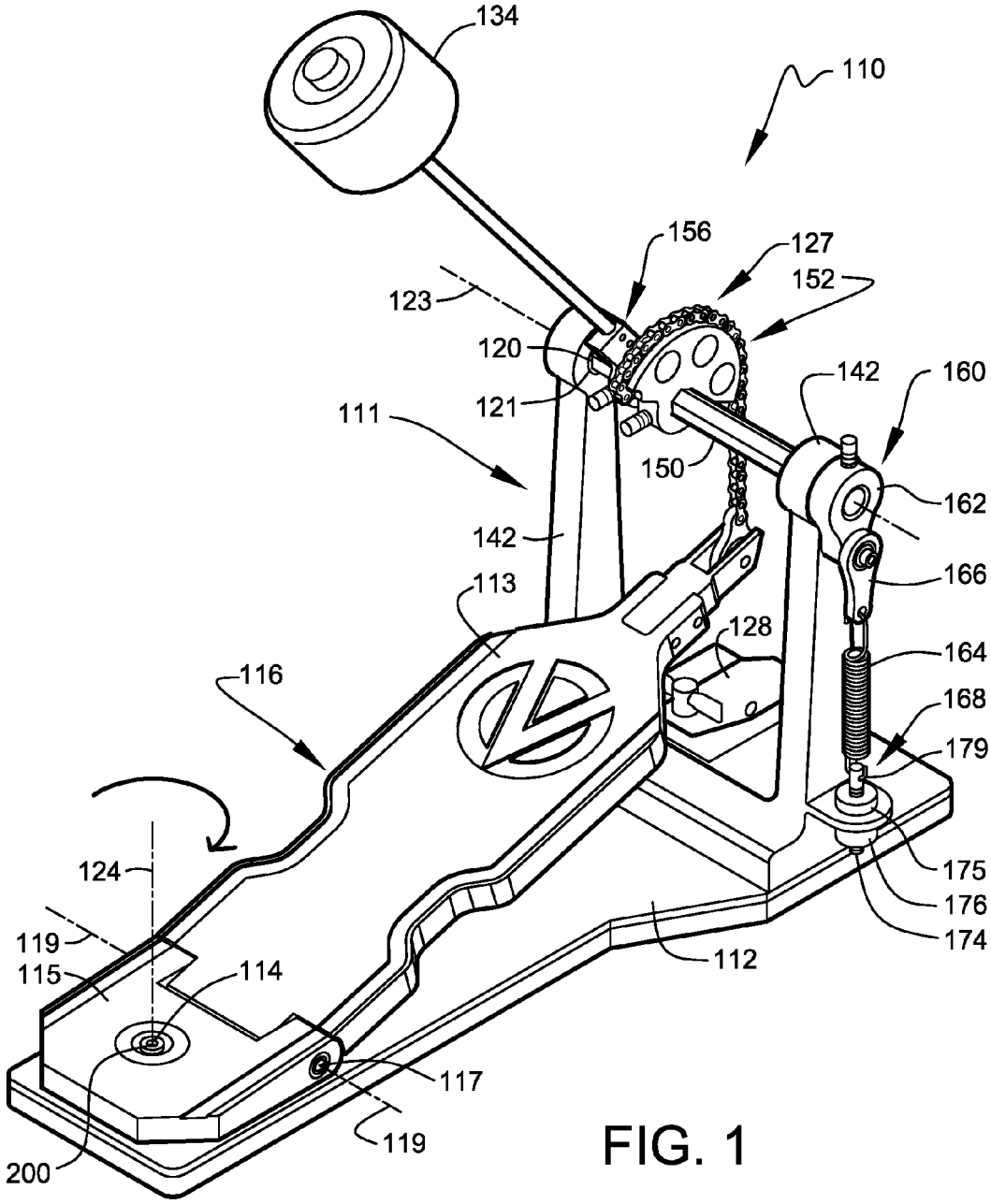
FIG. 1 shows a perspective view, showing a user-adjustable drum pedal, according to a preferred embodiment of the present invention.

FIG. 1 is a perspective view showing a user-adjustable drum pedal (hereinafter drum pedal 110) according to a preferred embodiment of the present invention. Drum pedal 110 preferably comprises positioning frame 111, supporting base plate 112, foot pedal 116, support columns 142, rotating crossbar 150, drum beater assembly 156, torque-generating member 152, spring assembly 160, and clamping device 128.

Foot pedal 116 is preferably adapted to receive at least one foot of a user (for example, a drum player) during use. Foot pedal 116 is preferably divided into toe-end portion 113 and heel-end portion 115, as shown. Toe-end portion 113 is preferably pivotally coupled to heel-end portion 115 by pivot hinge 117, as shown. Pivot hinge 117 preferably functions to enable up-and-down movement of toe-end portion 113 about first rotational axis 119.

Positioning frame 111 preferably comprises a supporting base plate 112 and a pair of spaced-apart vertical support columns 142, as shown. Base plate 112 is preferably adapted to support positioning frame 111 on a floor or similar supportive surface. Support columns 142 are preferably coupled to the forward portion of base plate 112 and preferably function to supportively elevate rotating crossbar 150, as shown. The upper portion of each support column 142 preferably comprises a hollow cylindrical bore 121, preferably fitted with at least one friction-reducing bearing 120 (see also the enlarged detail of FIG. 5) in which rotating crossbar 150 is preferably engaged (at least embodying herein wherein each such at least two support columns comprise at least one friction-reducing bearing structured and arranged to provide reduced-friction rotation of such at least one first rotatable support bar during such support). Positioning frame 111 is preferably configured to support rotating crossbar 150 (at least embodying herein at least one first rotatable support bar) in a substantially horizontal position, allowing rotation about second axis of rotation 123, at an elevation above toe-end portion 113, as shown.

Figure 6:
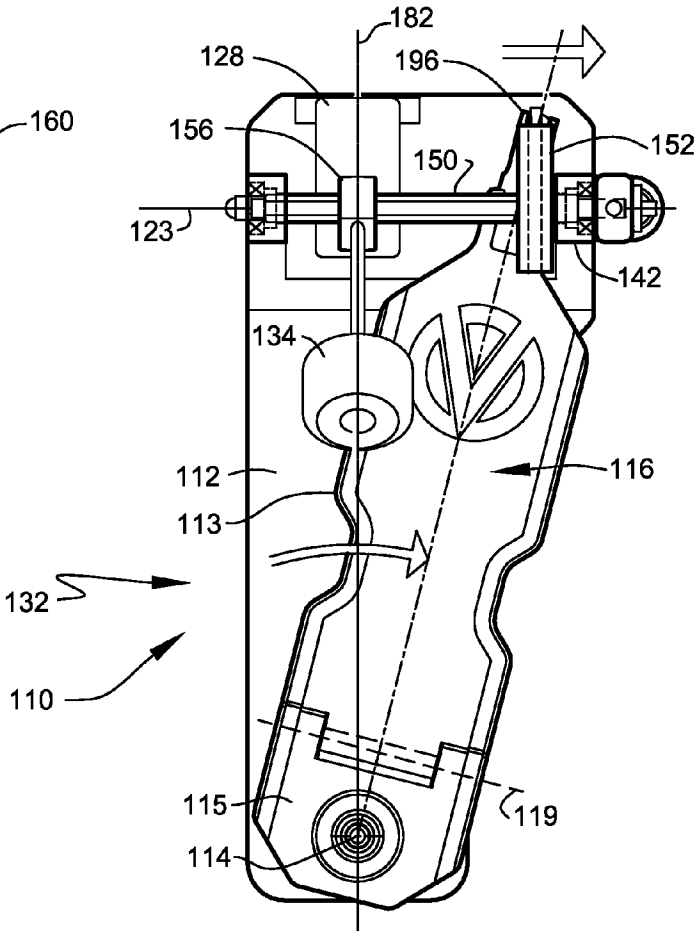
FIG. 6 shows a second top perspective view illustrating the user-adjustable drum pedal of FIG. 1 adjusted to a second angular position.
Figure 5:
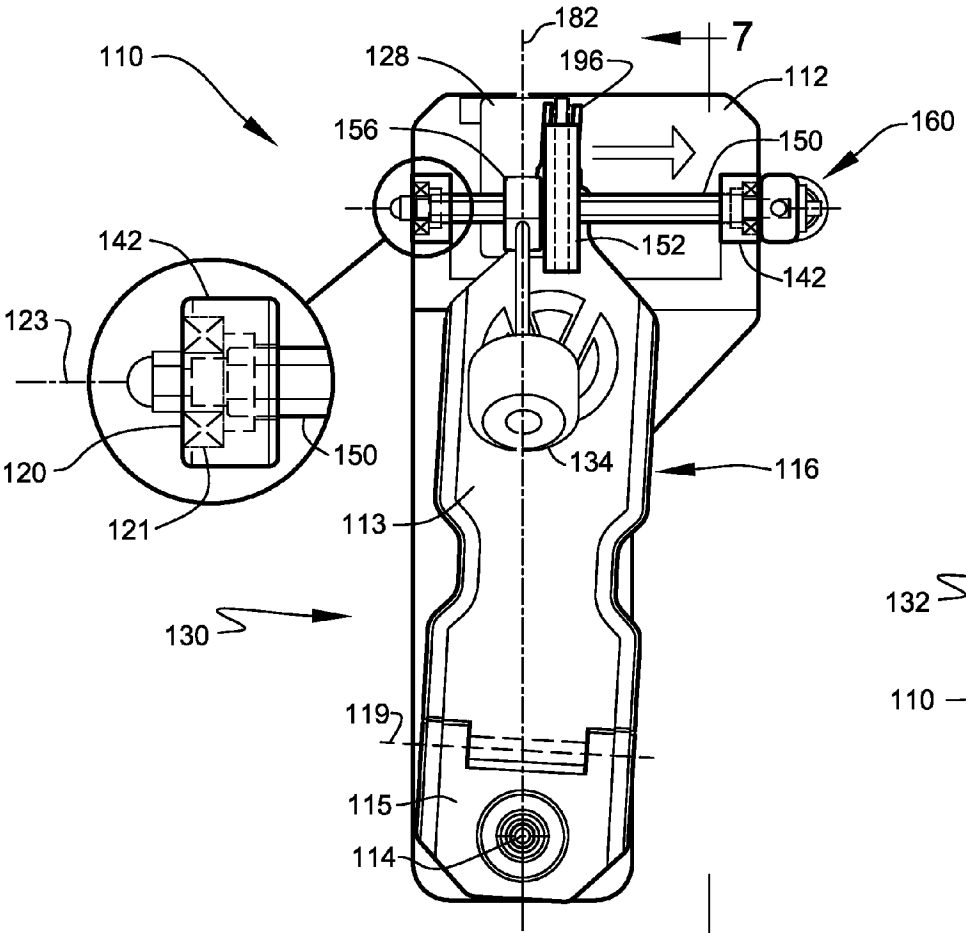
FIG. 5 shows a top perspective view illustrating the user-adjustable drum pedal of FIG. 1 adjusted to a first angular position.

A coupling mechanism 118 is preferably used to pivotally couple foot pedal 116 to base plate 112 and to preferably allow foot pedal 116 to pivot continuously through a range of angular positions (see also FIG. 5 and FIG. 6). Heel-end portion 115 of foot pedal 116 is preferably rotatable about a single pivot member 114 structured and arranged to provide side-to-side pivoting of toe-end portion 113 about a third rotational axis 124 intersecting heel-end portion 115 and oriented substantially perpendicular to first rotational axis 119, as shown. The location of pivot member 114 and third rotational axis 124 is preferably fixed relative to base plate 112 and the overall positioning frame 111.

Coupling mechanism 118 preferably comprises a mechanical lock 200 adapted to lock foot pedal 116 in a selected angular position. The user is thus preferably able to adjust foot pedal 116 to an angle most consistent with comfortable playing. More specifically, this preferred feature allows an individual user to establish a biomechanically correct playing position corresponding to particular physical characteristics of the individual percussionists.

Figure 2:
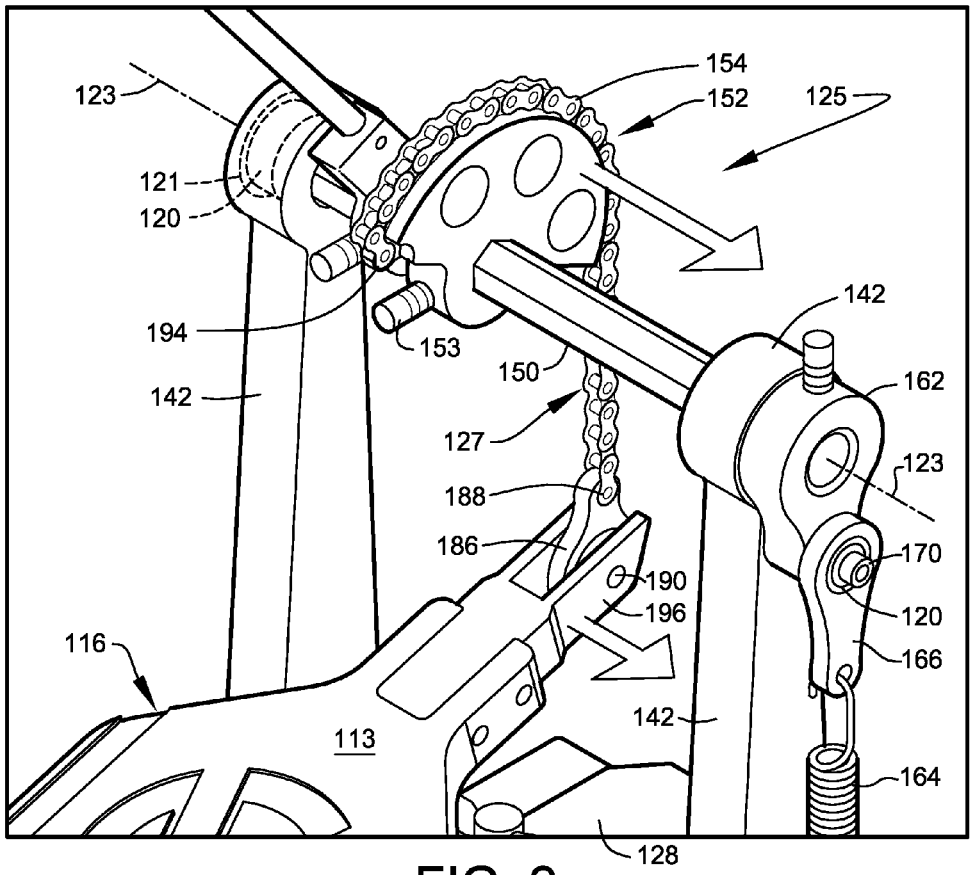
FIG. 2 shows a detailed perspective view, showing a preferred drive train comprising a rotating crossbar, user-adjustable cam actuator, roller chain, and drum beater assembly, according to the preferred embodiment of FIG. 1.

FIG. 2 is a detailed perspective view, showing a preferred drive train 125 preferably comprising rotating crossbar 150, user-adjustable torque-generating member 152, linkage 126, and drum beater assembly 156, according to the preferred embodiment of FIG. 1. Rotating crossbar 150 is preferably adapted to rotate about second axis of rotation 123 when a torque force is applied to crossbar 150. The torque force is preferably generated by a pressure force applied at toe-end portion 113 and transmitted to rotating crossbar 150 through drive train 125 (at least embodying herein at least one bar rotator structured and arranged to rotate such at least one rotatable support bar when pressure is applied to such at least one toe-end portion).

The wheel-like torque-generating member 152 is preferably configured to function as a torque arm preferably producing a rotation in rotatable crossbar 150 by the application of at least one torque-arm force. Torque-generating member 152 is preferably mounted to rotatable crossbar 150 so as to enable the concurrent rotation of both torque-generating member 152 and rotatable crossbar 150, while allowing lateral positional adjustment of torque-generating member 152 along rotatable crossbar 150 in a direction substantially parallel to second axis rotation 123 (as diagrammatically indicated by the arrow depiction of FIG. 2). This preferably maintains torque-generating member 152 in approximate vertical alignment with toe-end portion 113, as shown.

Torque-generating member 152 preferably comprises at least one user-operable release mechanism 153 to release torque-generating member 152 from rotatable crossbar 150 to allow lateral adjustment parallel to second axis rotation 123 (at least embodying herein wherein such at least one torque arm comprises at least one lateral adjuster structured and arranged allow lateral adjustment to the position of such at least one torque arm). Release mechanism 153 preferably comprises a square-head set screw passing through collar 127 of torque-generating member 152 to engage rotatable crossbar 150, as best illustrated in FIG. 3.

Torque-generating member 152 is preferably linked to toe-end portion 113 by at least one linkage 126, as shown. Linkage 126 is preferably adapted to transmit forces from toe-end portion 113 to torque-generating member 152. Linkage 126 preferably comprises a first coupler 186 adapted to couple a lower first end portion 188 of linkage 126 to connection point 190 of toe-end portion 113, as shown. Linkage 126 also comprises an upper connection to torque-generating member 152, preferably comprising a second coupler 192 adapted to couple a second end portion 194 of linkage 126 to torque-generating member 152. Linkage 126 preferably comprises a flexible member, most preferably at least one roller chain 154, as shown. Upon reading this specification, those with ordinary skill in the art will now appreciate that, under appropriate circumstances, considering such issues as cost, user preference, etc., other linkage arrangements such as, for example, flexible cords, cables, bands, etc., may suffice.

Figure 3:
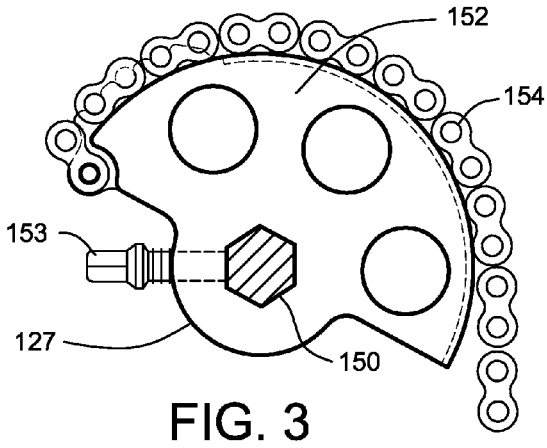
FIG. 3 shows a side elevation view of the user-adjustable cam actuator mounted on the rotating crossbar, according to the preferred embodiment of FIG. 1.
Figure 4:
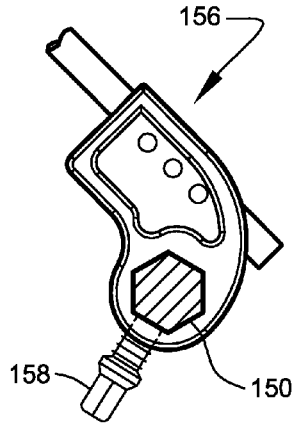
FIG. 4 shows a partial side elevation view of the drum beater assembly mounted on the rotating crossbar, according to the preferred embodiment of FIG. 1.

Referring to FIG. 3, drum beater assembly 156 (at least embodying herein at least one drum-striker) is preferably coupled with rotatable support bar 150, as shown. Drum beater assembly 156 is preferably mounted so as to strike the drum on rotation of rotatable support bar 150. When pressure is applied to foot pedal 116, a force is transmitted through roller chain 154 to torque-generating member 152 resulting in the concurrent generation of a torque force on rotating crossbar 150. This preferably results in a rotation of crossbar 150, which in turn rotates drum beater assembly 156. Upon reading this specification, those with ordinary skill in the art will now appreciate that, under appropriate circumstances, considering such issues as cost, user preference, etc., other force-transfer arrangements such as, for example, a rubber belt or like element, etc., may suffice.

Reference is again made to FIG. 1 with continued reference to FIG. 2. Spring assembly 160 preferably comprises cam 162, spring 164, low-friction linkage 166, and spring-tension adjuster 168, as shown. Cam 162 is preferably coupled to rotating crossbar 150 such that both rotate concurrently. The upper end of spring 164 is preferably coupled to low-friction linkage 166 by an aperture engagement, as shown. Low-friction linkage 166 is preferably coupled to cam 162 at pivot 170, as shown. Pivot 170 preferably comprising a friction-reducing bearing 120, as shown. In this preferred arrangement, spring 164 is eccentrically coupled to rotating crossbar 150 via low-friction linkage 166 and cam 162. Upon reading this specification, those with ordinary skill in the art will now appreciate that, under appropriate circumstances, considering such issues as cost, user preference, etc., other arrangements such as, for example, connecting a spring to a cam directly, etc., may suffice.

The lower end of spring 164 is preferably coupled to the adjacent support column 142, or other fixed structure of positioning frame 111, via spring-tension adjuster 168, as shown. Spring-tension adjuster 168 preferably comprises threaded rod 174 that is preferably adapted to be vertically adjustable by rotation of threaded nut 176. The tension of spring 164 is preferably settable by adjusting the vertical position of connection point 179 of spring 164 at threaded rod 174. A lock nut 175 is preferably used to lock threaded rod 174 in the selected position once adjusted. In this way, the return force "action" of the pedal can be adjusted to the user's preference.

When pressure is applied to foot pedal 116, rotatable crossbar 150 preferably rotates causing drum beater assembly 156 to strike the bass drum. When pressure is removed from foot pedal 116, spring assembly 160 preferably operates to bring the rotatable crossbar 150 back to its original resting position preferably drawing drum beater assembly 156 back away from the bass drum (at least embodying herein at least one first striker-return assembly structured and arranged to return such at least one drum-striker to at least one starting position when pressure is removed from the at least one foot pedal; and at least embodying herein wherein such at least one first striker-return assembly comprises at least one spring structured and arranged to generate at least one biasing force having at least one first end coupled with such at least one positioning frame and at least one second end eccentrically coupled with such at least one rotatable support bar).

Figure 7:
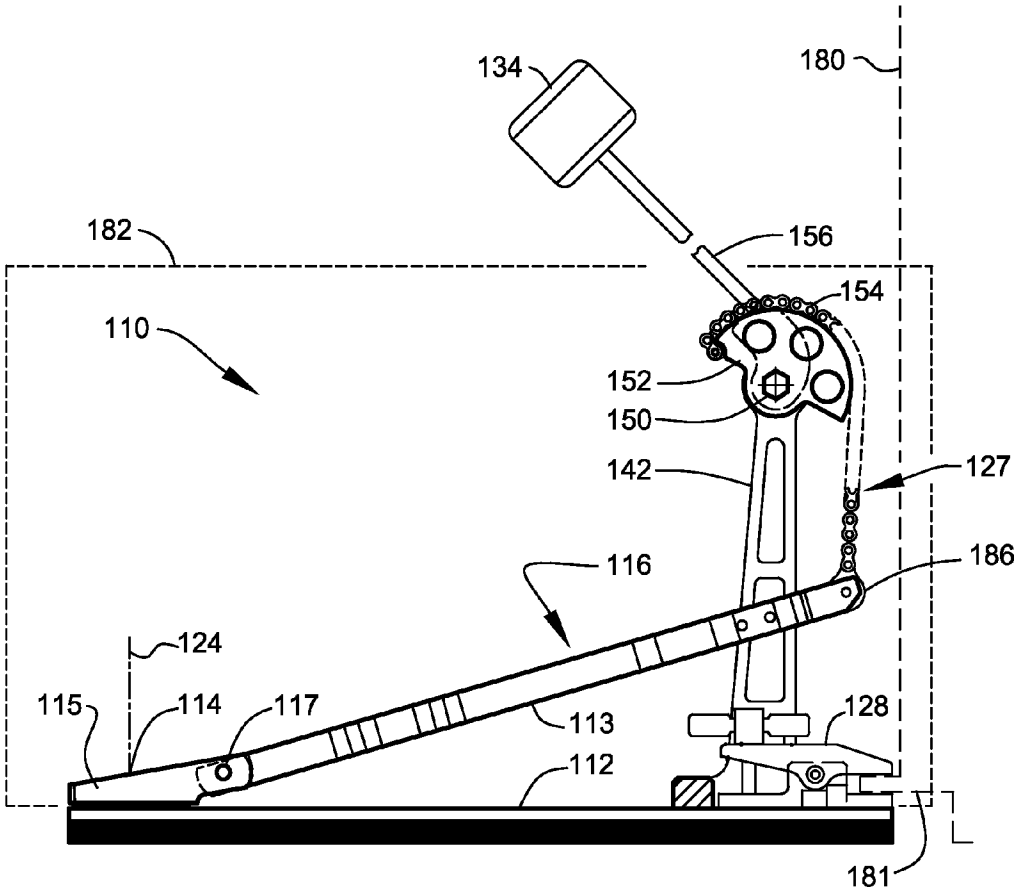
FIG. 7 shows a perspective view through the section 7-7 of FIG. 5.

Clamping device 128 is preferably used to attach positioning frame 111 of drum pedal 110 to rim 181 of bass drum 180 (see FIG. 7). By tightening clamping device 128, the operator secures foot pedal 110 to rim 181 of the bass drum 180. In general, the operator mounts clamping device 128 to the lowest point of rim 181. This preferred mounting position places mallet 134 of drum beater assembly 156 in an ideal alignment relative to the membrane of bass drum 180.

Figure 8:
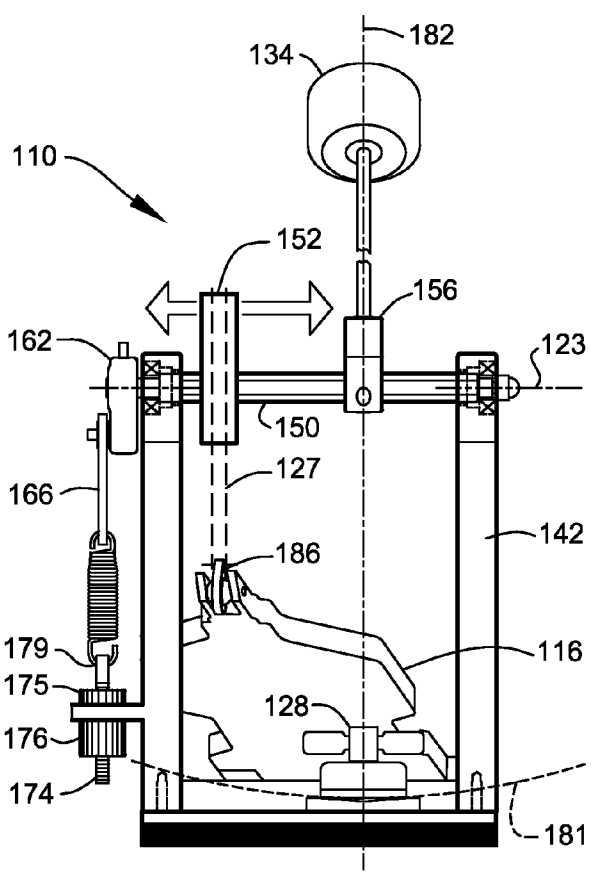
FIG. 8 shows a front view is of the user-adjustable drum pedal of FIG. 1.

FIG. 5 shows a top perspective view illustrating drum pedal 110 of FIG. 1 adjusted to first angular position 130. FIG. 6 shows a second top perspective view illustrating drum pedal 110 of FIG. 1 adjusted to second angular position 132. In second angular position 132, foot pedal 116 has been rotated to the right. FIG. 7 shows a perspective view through the section 7-7 of FIG. 5. FIG. 8 shows a front view of drum pedal 110. In the following descriptions, the terms "left" and "right" should be oriented in relation to a player using the embodiments described herein.

As previously noted, torque-generating member 152 is preferably repositionable along the length of rotatable crossbar 150, as shown. More specifically, torque-generating member 152 is preferably configured to translate horizontally, in a direction parallel to second axis of rotation 123 in coordination with the side-to-side adjustments of toe-end portion 113 about first rotational axis 119. The user may preferably place torque-generating member 152 at any selected position along the unsupported length of rotating crossbar 150 (not occupied by drum beater assembly 156). This preferred adjustment feature assists in maintaining the appropriate operational geometry within the components of the drive assembly, as the angle of foot pedal 116 is adjusted. This preferred arrangement results in an increase to the functional range of angular adjustability within drum pedal 110.

In the preferred embodiment of FIG. 1, drum beater assembly 156 is preferably coupled to rotating cross bar 150 at a substantially fixed position relative to positioning frame 111. Preferably, both drum beater assembly 156 and clamping device 128 are each alignable to at least one position of intersection with a substantially vertical plane 182 extending through pivot member 114 and oriented substantially perpendicular second axis of rotation 123, as shown. This preferred geometrical relationship allows mallet 134 of drum beater assembly 156 to strike an ideal point at or near the center of the bass drum, while maintaining the heel of the user's foot in correct alignment with the midline of bass drum 180 (see FIG. 8). By maintaining the heel of the user in alignment with the midline of bass drum 180, the lower leg of the user is preferably position in an optimal relationship to the adjacent instrument(s). It is noted that this optimal relationship could not be achieved by, for example, the pivoting of the heel-end portion about the toe-end portion.

Drum beater assembly 156, clamping device 128, and pivot member 114 are preferably maintained in a fixed positional relationship by positioning frame 111. The range of angular adjustment of foot pedal 116 is preferably maximized by the mounting of torque-generating member 152 to the right of drum beater assembly 156 (relative to the player during use). This highly preferred relationship allows for long axial translations of torque-generating member 152 to the right of vertical plane 182. This preferred configuration is important to maximizing the degree of clock-wise rotation available to foot pedal 116 about second axis of rotation 123. Upon reading this specification, those with ordinary skill in the art will now appreciate that, under appropriate circumstances, considering such issues as cost, user preference, etc., other alignment arrangements such as, for example, allowing a user to realign the components to best fit a specific instrument, etc., may suffice.

It is noted that all preferred embodiments of the present invention preferably locate torque-generating member 152 drum to the right of beater assembly 156, as shown. This preferred arrangement also allows the pedal embodiments to be positioned off center of the base drum hoop, and by adjusting the pedal angle to optimally line up with the user's foot; preferably allows the user to fundamentally change the user's stance, from a counter-clockwise stance to a more ergonomic straight facing one. This preferably brings the instrument within easier reach of the player. The player's movements around the drums become more natural and effortless, thus allowing the player/user to improve his or her performance.

As previously noted, proper operational geometry within drive train 125 is maintained by the preferred positioning of torque-generating member 152 in vertical alignment with toe-end portion 113. To further facilitate the maintaining of proper operational geometries within the drive train during pedal adjustment, first coupler 186 of roller chain 154 preferably comprises swivel coupling 184 (at least embodying herein at least one second coupler structured and arrange couple a second end portion of such at least one linkage to such at least one torque arm).

Figure 9:
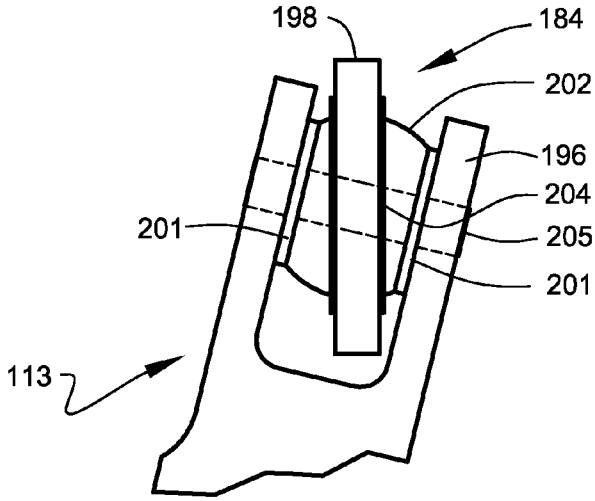
FIG. 9 shows a partial top view of a swivel coupling according to the preferred embodiment of FIG. 1.
Figure 10:
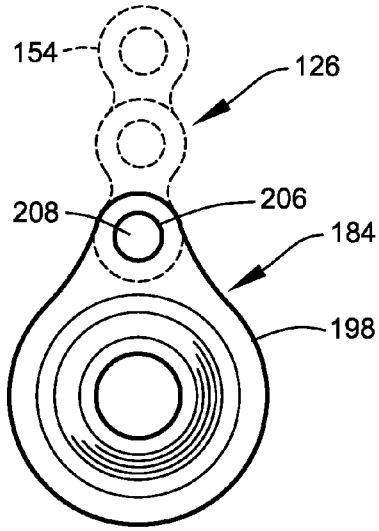
FIG. 10 shows an exploded view of the swivel coupling of FIG. 9 illustrating individual components of the preferred assembly.
Figure 11:
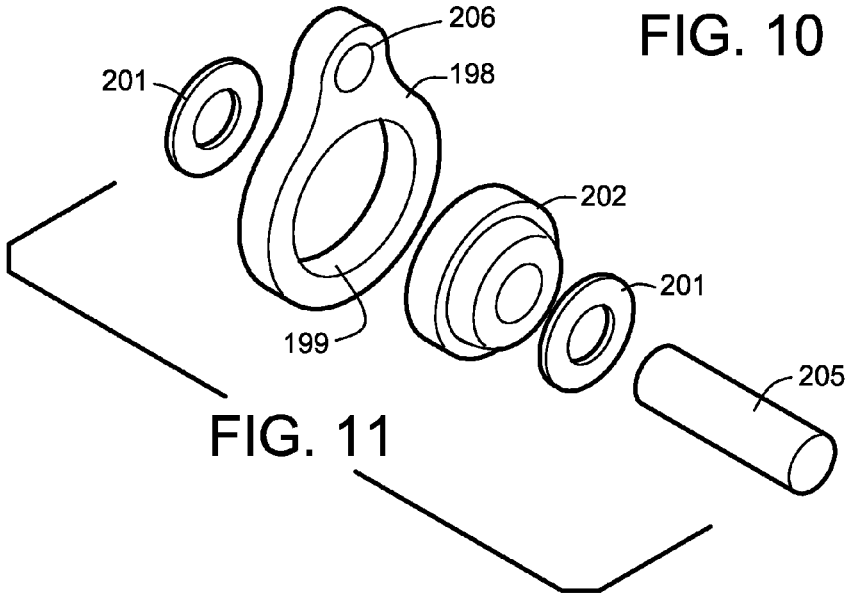
FIG. 11 shows an assembled side view of the swivel coupling of FIG. 9.

FIG. 9 shows a partial top view of a preferred swivel coupling 184 used to couple roller chain 154 to toe-end portion 113. FIG. 10 shows an exploded view of the swivel coupling 184 of FIG. 9, illustrating individual components of the preferred assembly. FIG. 11 shows an assembled side view of the swivel coupling 184. Reference is now made to FIG. 9 through FIG. 11, with continued reference to FIG. 2.

When the relative orientations of the laterally-adjustable torque-generating member 152 and foot pedal 116 are adjustable to accommodate the preferred playing position of a drum player, linkage 126 coupling the two structures typically experiences a degree of angular misalignment. To accommodate this condition, linkage 126 preferably comprises at least one swivel coupling 184, as shown. Swivel coupling 184 is preferably used to couple first end portion 188 to a distal fork-shaped fitting 196 of toe-end portion 113, as shown. Swivel coupling 184 preferably functions to limit the twisting of roller chain 154 by substantially isolating roller chain 154 from divergent changes in angular orientation expressed at the end of toe-end portion 113.

Swivel coupling 184 preferably comprises a coupling member 198 having a central bore 199 adapted to receive at least one spherical bearing 202, as shown. A transverse pin 205 engages both spherical bearing 202 and fork-shaped fitting 196 and preferably forms a central connection point 204 about which spherical bearing 202 swivels. Spherical bearing 202 is preferably structured and arranged to permit angular rotation of the coupled components, about central connection point 204, during angular adjustment of foot pedal 116. A set of nylon washers 201 are preferably placed at each side of spherical bearing 202 to assist in reducing friction between the bearing faces and fork-shaped fitting 196. The upper portion of coupling member 198 preferably comprises aperture 206 adapted to receive a connector pin 208 used to join coupling member 198 to an end link of roller chain 154, as shown.

It is noted that fork-shaped fitting 196 is preferably adapted to be removable from toe-end portion 113 to allow alternate linkage types to be used within drive train 125. In this preferred arrangement, a fork-shaped fitting 196 and torque-generating member 152 compatible with, for example, a flexible cord may be substituted within the roller chain assembly.

It is also noted that, in alternate preferred embodiments of the present invention, drum beater assembly 156 may be coupled to rotating cross bar 150 in a releasable manner. In this case drum beater assembly 156 preferably comprises at least one release mechanism 158. Release mechanism 158 preferably allows drum beater assembly 156 to slide along rotatable crossbar 150 and to be placed at any selected position on the crossbar. This feature also necessitates the use of an adjuster at clamping device 128, as the beater and clamp function best when maintained in alignment.

Figure 12:
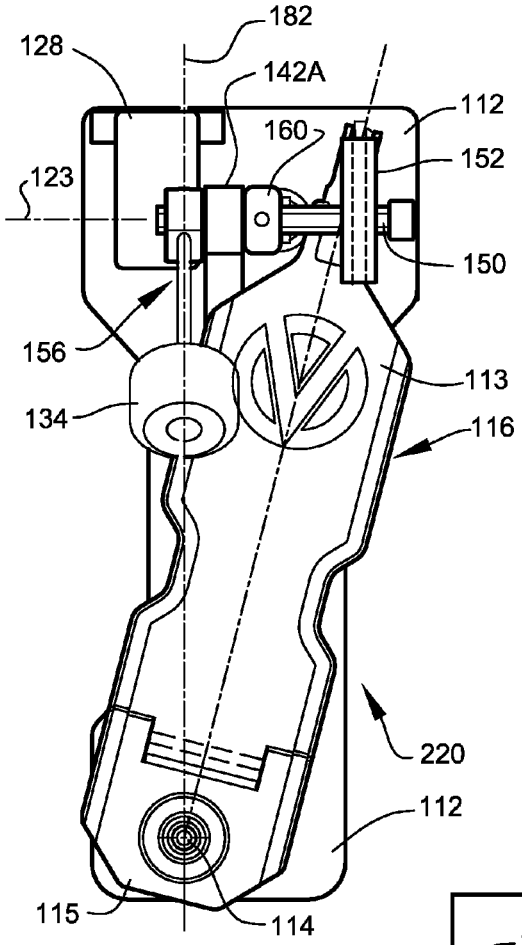
FIG. 12 shows a top view illustrating a single column user-adjustable drum pedal according to an alternate preferred embodiment of the present invention.
Figure 13:
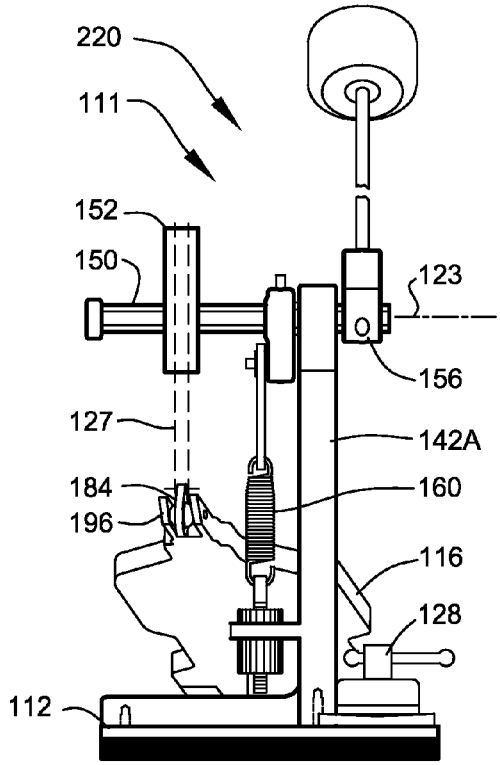
FIG. 13 shows a front view illustrating the single column user-adjustable drum pedal according to the preferred embodiment of FIG. 12.
Figure 14:
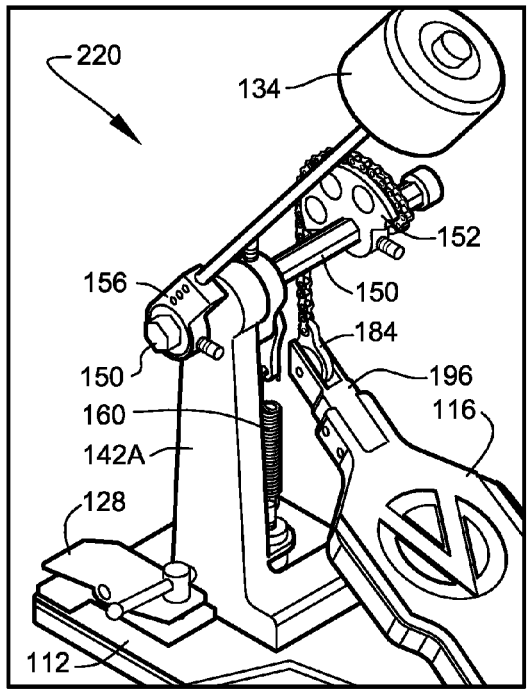
FIG. 14 shows a partial perspective view illustrating the single column user-adjustable drum pedal of FIG. 12.

FIG. 12 shows a top view illustrating single-column user-adjustable drum pedal (hereinafter referred to as single-column drum pedal 220) according to an alternate preferred embodiment of the present invention. FIG. 13 shows a front view illustrating single-column drum pedal 220 according to the preferred embodiment of FIG. 12. FIG. 14 shows a partial perspective view illustrating single-column drum pedal 220 of FIG. 12. It is noted that single-column drum pedal 220 comprises physical arrangements substantially similar to the preferred embodiment of FIG. 1; thus, only the differences between single-column drum pedal 220 and the prior embodiment will be elaborated upon.

In the preferred structures and arrangements of single-column drum pedal 220, rotatable crossbar 150 is preferably supported by a single vertical support column 142A, as shown. Rotatable crossbar 150 preferably passes through the single vertical support column 142A, as shown. To provide the most advantageous range of pedal orientations; drum beater assembly 156 is preferably mounted on rotatable crossbar 150 in a preferred position to the left of support column 142A, as shown. Furthermore, torque-generating member 152 is preferably located to the right of support column 142A, as shown. Torque-generating member 152 is preferably mounted to rotatable crossbar 150 so as to enable the concurrent rotation of both torque-generating member 152 and rotatable crossbar 150, while allowing lateral positional adjustment of torque-generating member 152 along the cantilevered portion of rotatable crossbar 150, in a direction substantially parallel to second axis rotation 123.

Base plate 112 is preferably modified to align clamping device 128 with the alternate location of drum beater assembly 156, as shown. As in the prior embodiment of FIG. 1, both drum beater assembly 156 and clamping device 128 are preferably aligned to at least one position of approximate intersection with a substantially vertical plane 182 extending through pivot member 114 and oriented substantially perpendicular second axis of rotation 123, as shown. In a preferred alternate embodiment of the present invention, the angle of foot pedal 116 is fixed relative to the frame.

In the preferred structures and arrangements of single-column drum pedal 220, spring assembly 160 is preferably located to the right of support column 142A, as shown. Upon reading this specification, those with ordinary skill in the art will now appreciate that, under appropriate circumstances, considering such issues as cost, user preference, etc., other arrangements such as, for example, locating both the spring assembly and beater on the opposing side of the column, etc., may suffice.

Figure 15:
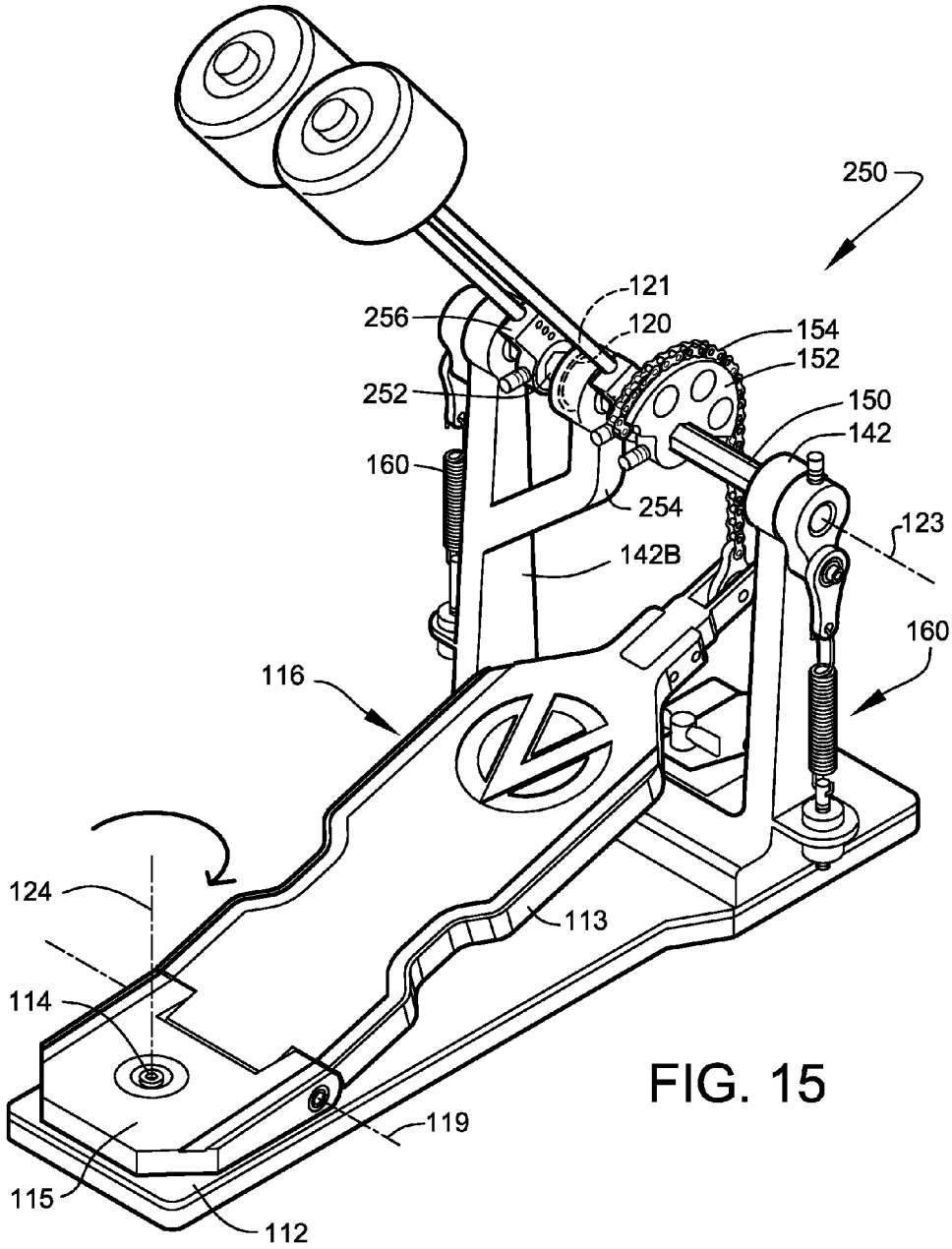
FIG. 15 shows a perspective view illustrating a double beater user-adjustable drum pedal according to a preferred embodiment of the present invention.

FIG. 15 shows a perspective view illustrating a double beater user-adjustable drum pedal (hereinafter referred to as double-beater foot pedal 250) according to a preferred alternate embodiment of the present invention. It is noted that double-beater foot pedal 250 preferably comprises physical arrangements similar to the preferred embodiment of FIG. 1; therefore, only the differences between double-beater foot pedal 250 and the prior embodiment will be elaborated upon.

Double-beater foot pedal 250 preferably comprises an additional rotating crossbar 252 adapted to provide rotatable crossbar support about second axis of rotation 123, substantially independent of rotating crossbar 150. The additional rotating crossbar 252 is preferably supported within a modified arrangement of support columns, as shown. In this preferred arrangement, the leftmost support column 142B is preferably bifurcated to comprise an additional upper arm portion 254, as shown. Upper arm portion 254 preferably comprising an additional hollow cylindrical bore 121 preferably fitted with a pair of friction-reducing bearings 120 in which rotating crossbar 150 and additional rotating crossbar 252 are respectively engaged.

An additional drum beater assembly 256 is preferably coupled with the additional rotating crossbar 252, as shown. The additional drum beater assembly 256 is preferably structured and arranged to be actuated independently of foot pedal 116 by an external rotation-generating torque force applied to the additional rotating crossbar 252. In addition, at least one additional spring assembly 160 (at least embodying herein at least one additional striker-return assembly) is preferably coupled to the additional rotating crossbar 252 and support column 142B to return the additional drum beater assembly 156 to at least one starting position when the additional rotation-generating torque force is removed from the additional rotating crossbar 252. Torque-generating member 152 is preferably mounted to rotatable crossbar 150 so as to enable the concurrent rotation of both torque-generating member 152 and rotatable crossbar 150, while preferably allowing lateral positional adjustment of torque-generating member 152 along rotatable crossbar 150 in a direction substantially parallel to second axis rotation 123. Torque-generating member 152 is preferably mounted to the right of both drum beater assemblies, as shown.

Figure 16:
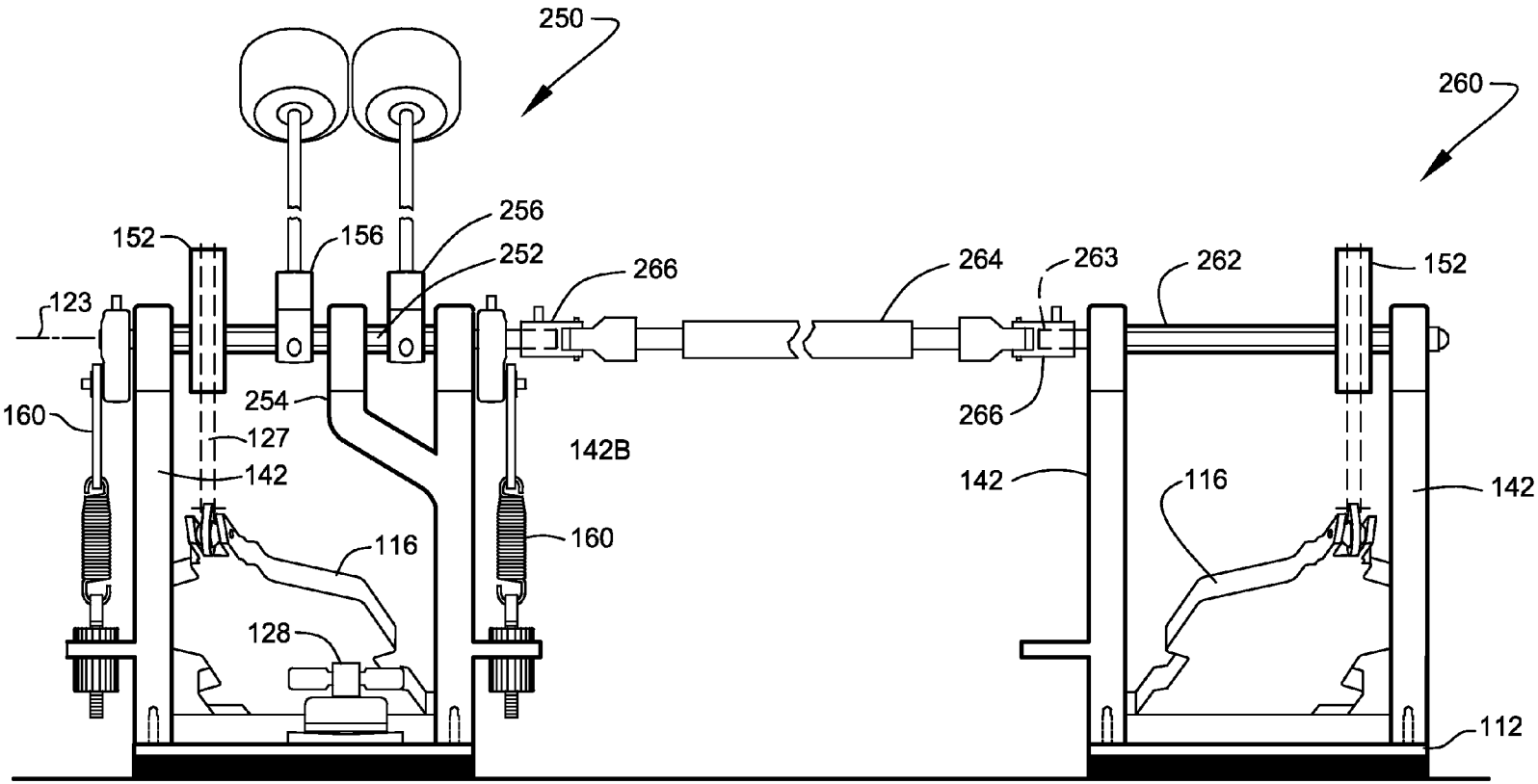
FIG. 16 shows a front view illustrating the double beater user-adjustable drum pedal coupled with another user-adjustable drum pedal, according to a preferred embodiment of the present invention.

FIG. 16 shows a front view illustrating double-beater foot pedal 250 operably coupled with a second user-adjustable drum pedal 260, according to a preferred embodiment of the present invention. The preferred combination of double-beater foot pedal 250 and second user-adjustable drum pedal 260 enables the playing of a bass drum selectively by either foot. The additional user-adjustable drum pedal 260 preferably functions to generate the additional external rotation-generating torque force used to rotate the additional rotating crossbar 252 and additional drum beater assembly 256 of double-beater foot pedal 250. As in the prior embodiments, the rotation-generating torque force is preferably generated when pressure is applied to foot pedal 116 user-adjustable drum pedal 260.

User-adjustable drum pedal 260 preferably comprises structures and arrangements substantially similar to those of drum pedal 110; however, user-adjustable drum pedal 260 is preferably organized in a configuration symmetrically opposite to that of drum pedal 110, as shown. In addition, user-adjustable drum pedal 260 preferably omits a drum beater assembly and return spring in favor of an extension 263 of rotatable crossbar 262, preferably allowing the mounting of a rotary force-transfer linkage 264, as shown. Force-transfer linkage 264 preferably functions to transfer a rotation-generating torque force generated at user-adjustable drum pedal 260 to the additional rotating crossbar 252 of double-beater foot pedal 250, as shown. The rotary force-transfer linkage 264 preferably comprises at least one angular adjuster 266 to allow user-selected angular adjustments of user-adjustable drum pedal 260 relative to the rotational axis of rotating crossbar 252. This preferred feature allows a player to adjust the angular position of user-adjustable drum pedal 260, relative to double-beater foot pedal 250, to facilitate player comfort during use.

Figure 17B:
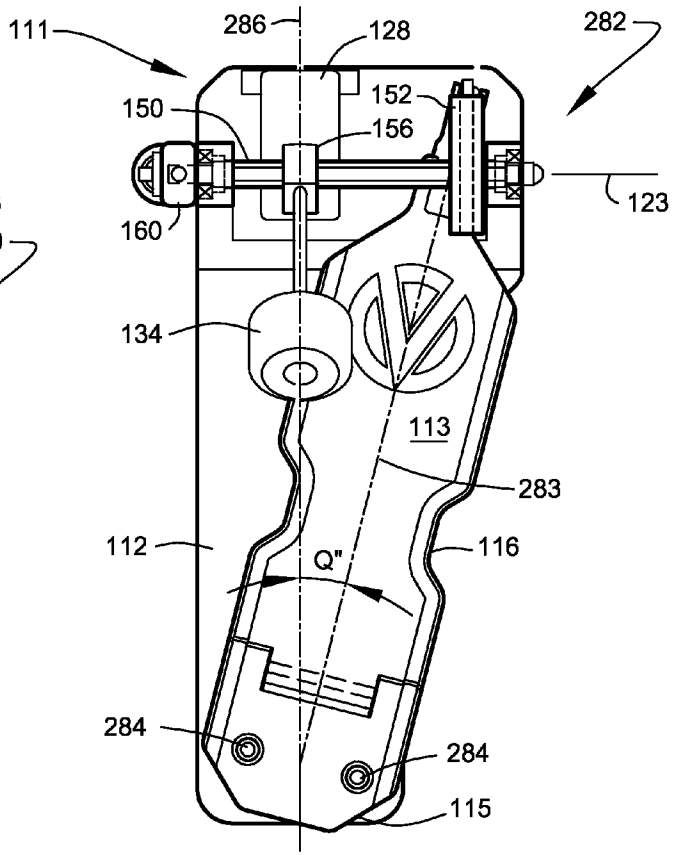
FIG. 17B shows a second fixed-angle drum pedal according to another preferred embodiment of the present invention.
Figure 17A:
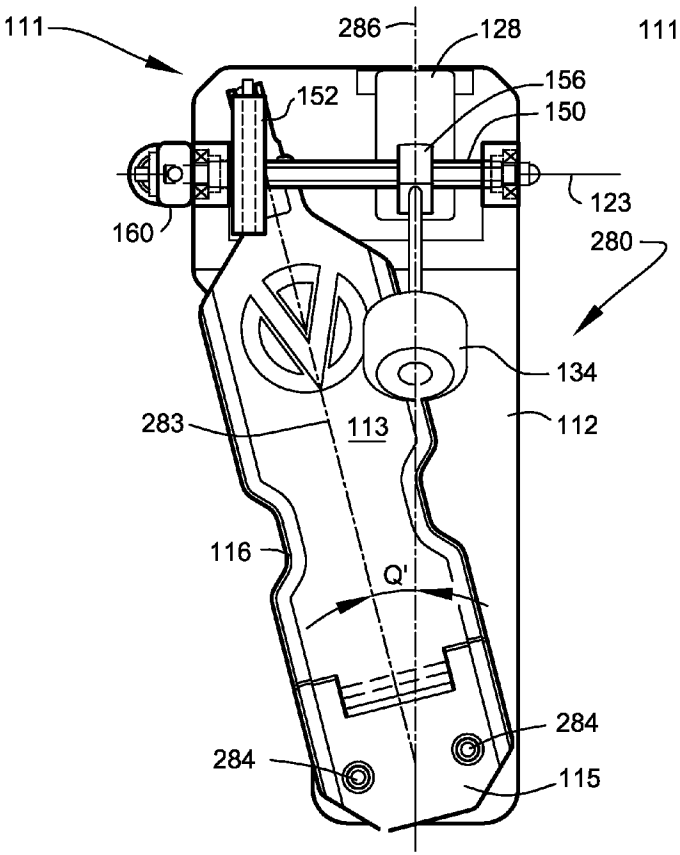
FIG. 17A shows a first fixed-angle drum pedal according to another preferred embodiment of the present invention.

FIG. 17A shows a first fixed-angle drum pedal 280 according to an alternate preferred embodiment of the present invention. FIG. 17B shows a second fixed-angle drum pedal 282 according to another alternate preferred embodiment of the present invention. It is noted that the physical arrangements of first fixed-angle drum pedal 280 and second fixed-angle drum pedal 282 are substantially similar to the preferred embodiment of FIG. 1; therefore, only the differences between the embodiments will be elaborated upon.

In both the first fixed-angle drum pedal 280 and second fixed-angle drum pedal 282, respective foot pedals 116 are preferably mounted at a fixed (non-adjustable) angle, as shown. This preferred feature produces a simpler, more robust, and cost-effective overall assembly.

First fixed-angle drum pedal 280 and second fixed-angle drum pedal 282 each preferably comprise a rigid pedal mount 284 structured and arranged to rigidly mount respective heel-end portions 115 to a respective base plate 112 of their respective positioning frame 111, as shown. Within each of the fixed-angle drum pedals, the preferred relative positions of drum beater assembly 156, clamping device 128, and heel-end portion 115 are positionally fixed by the structures of positioning frame 111. Within each of the fixed-angle drum pedals, drum beater assembly 156, clamping device 128, and heel-end portion 115 are each geometrically aligned to intersect a substantially vertical plane 286 oriented substantially perpendicular to second axis of rotation 123, as shown. Within each of the fixed-angle drum pedals, the longitudinal axis 283, extending between toe-end portion 113 and heel-end portion 115, preferably comprises a fixed acute angle relative to its respective vertical plane 286, as shown in FIG. 17A. In first fixed-angle drum pedal 280, the fixed acute angle Q' is preferably oriented to the left of vertical plane 286, as shown. In second fixed-angle drum pedal 282, the fixed acute angle Q" is preferably oriented to the right of vertical plane 286, as shown in FIG. 17B. Within each of the fixed-angle drum pedals, the fixed acute angle (Q' and Q") preferably comprises an angle measurement of between about one degree and about forty-five degrees, as shown.

Upon reading this specification, those with ordinary skill in the art will now appreciate that, under appropriate circumstances, considering such issues as cost, user preference, etc., other fixed pedal arrangements such as, for example, forming a hinged member integrally with a base plate, providing a custom-fitted drum pedal wherein the pedal is fixed at an optimal user-specific angle, using a single support column, etc., may suffice.

Figure 18:
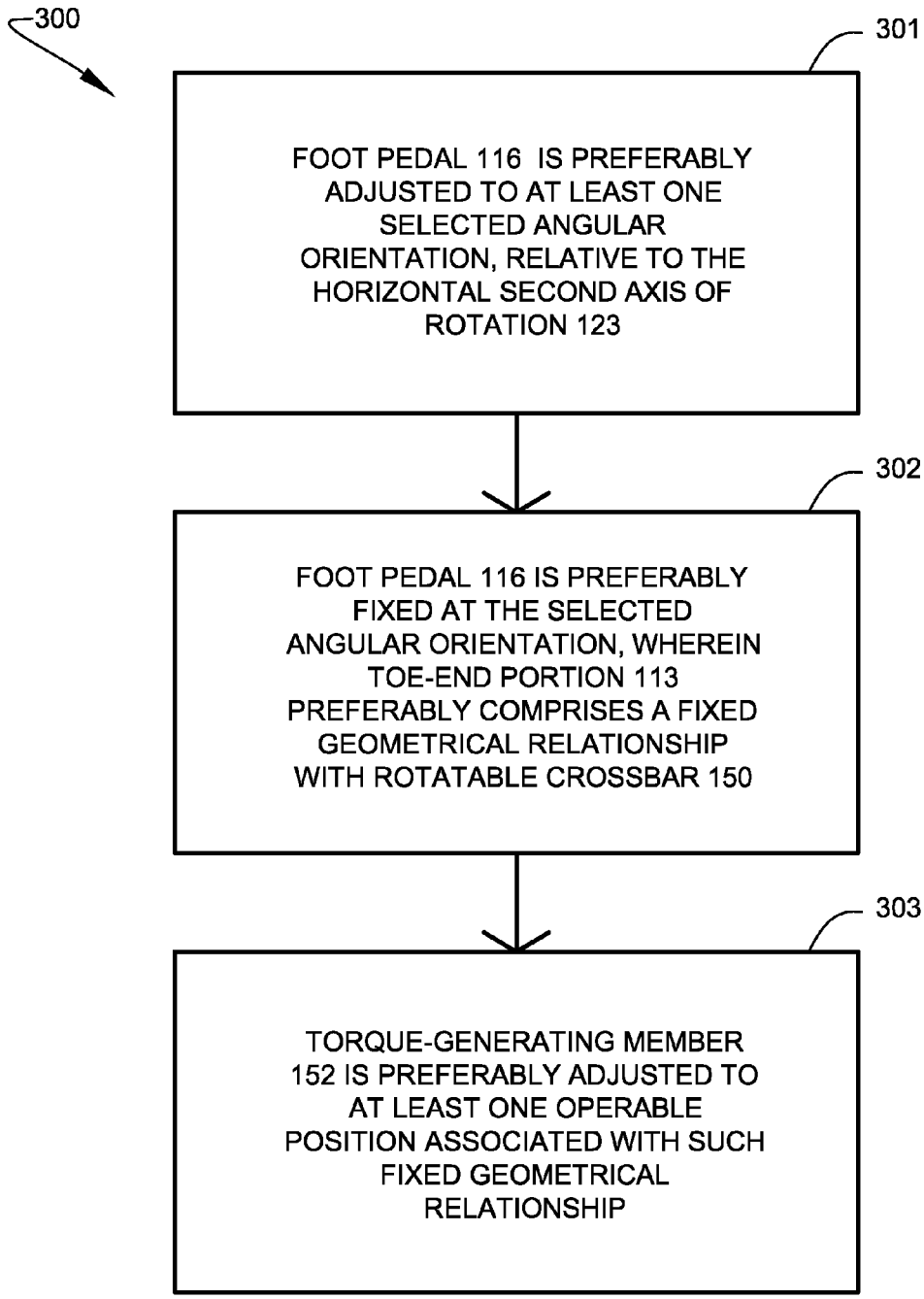
FIG. 18 shows a flow diagram depicting preferred steps of a preferred method related to establishing an ergonomically correct foot placement during foot-actuated playing of at least one drum, according to the present invention.
Figure 28:
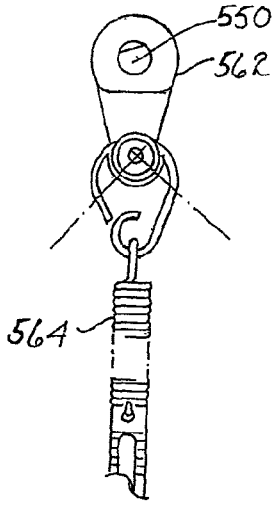
FIG. 28 shows a cross section view of the spring mechanism used in the adjustable drum pedal taken along lines 28-28 of FIG. 23.
Figure 24:
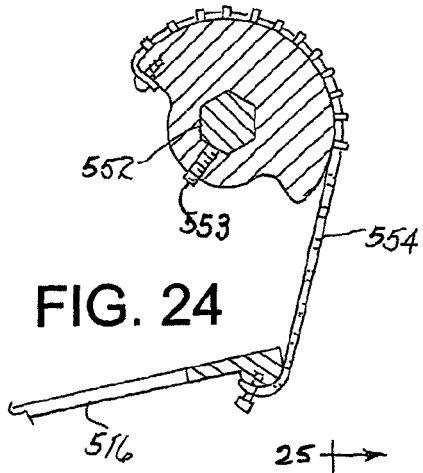
FIG. 24 shows a cross sectional side view of the cam mechanism used in the adjustable drum pedal taken along lines 24-24 of FIG. 23.

FIG. 18 is a flow diagram depicting the steps of preferred method 300. Method 300 of the present invention preferably relates to establishing an ergonomically correct foot placement, on at least one foot-actuated drum pedal assembly, by at least one drum player during foot-actuated playing of at least one drum. Method 300 is preferably applicable to each of the adjustable pedal embodiments of the prior descriptions. The foot-actuated drum pedal assembly of method 300 may, for example, preferably comprise drum pedal 110 of FIG. 1 having a foot pedal 116, at least one rotatable crossbar 150, at least one drum beater assembly 156, at least one laterally-adjustable torque-generating member 152 adapted to rotate rotatable crossbar 150 about the horizontal second axis of rotation 123 when pressure is applied to foot pedal 116.

In the initial step 301 of method 300, foot pedal 116 (see FIG. 1) is preferably adjusted to at least one selected angular orientation, relative to the horizontal second axis of rotation 123, preferably by rotating toe-end portion 113 of foot pedal 116 about a pivot point (preferably at pivot member 114) within heel-end portion 115. In alternated preferred embodiments of the present invention (see FIG. 32), the pivot point of foot pedal 116 is also adjustable side-to-side along a line substantially parallel to second axis of rotation 123. Next, as indicated in preferred step 302, foot pedal 116 is preferably fixed at the selected angular orientation, wherein toe-end portion 113 preferably comprises a fixed geometrical relationship with rotatable crossbar 150 (embodying herein at least one rotatable support bar). Next, torque-generating member 152 (embodying herein at least one laterally-adjustable bar rotator) is preferably adjusted to at least one operable position associated with such fixed geometrical relationship, as indicated in preferred step 303. The operable position associated with such fixed geometrical relationship is preferably the previously-described vertical alignment of torque-generating member 152 with toe-end portion 113.

Referring now to the FIG. 19, an adjustable drum pedal 510 (hereinafter drum pedal 510) is shown. Drum pedal 510 preferably comprises base plate 512. Base plate 512 preferably has first slot 514 preferably located along a bottom section of base plate 512, as shown. Slot 514 preferably runs along the majority of the transverse width of base plate 512. Foot pedal 516 is preferably movably coupled to base plate 512 within first slot 514. Coupling mechanism 518 is preferably used to movably couple foot pedal 516 to base plate 512 and to allow foot pedal 516 to pivot in a vertical manner.

Referring now to FIG. 20 wherein like numerals and symbols represent like elements, a magnified view of coupling mechanism 518 is shown. Coupling mechanism 518 preferably comprises tab member 520. Tab member 520 is preferably of a size to secure foot pedal 516 within first slot 514. Tab member 520 allows foot pedal 516 to slide within first slot 514. Tab member 520 further preferably allows foot pedal 516 to rotate about the tab member. Thus, tab member 520 allows the operator of drum pedal 510 to quickly and easily adjust the position of foot pedal 516 relative to base plate 512. The operator is then preferably able to comfortably place his/her foot completely on foot pedal 516 no matter what size, shape or alignment problem he/she may have.

Coupling mechanism 518 further preferably comprises hinged member 522. In the embodiment depicted in FIG. 21, hinged member 522 is preferably coupled to tab member 520. However, it should be noted that tab member 520 and hinged member 522 may be formed of a single piece. In the present embodiment, hinged member 522 is preferably coupled to tab member 520 via one or more connectors 524. Foot pedal 516 is preferably coupled to hinged member 522 by a pin 526. Pin 526 preferably allows foot pedal 516 to pivot about hinged member 522.

Referring now to FIG. 22 wherein like numerals and symbols represent like elements, clamping device 528 is shown. Clamping device 528 is preferably used to attach the drum pedal 510 to a rim of a bass drum 530. A preferred feature of clamping device 528 is the ability of clamping device 528 to be laterally adjustable. Clamping device 528 preferably allows the operator to adjust the position of drum pedal 510 in relation to the bass drum 530.

Figure 26:
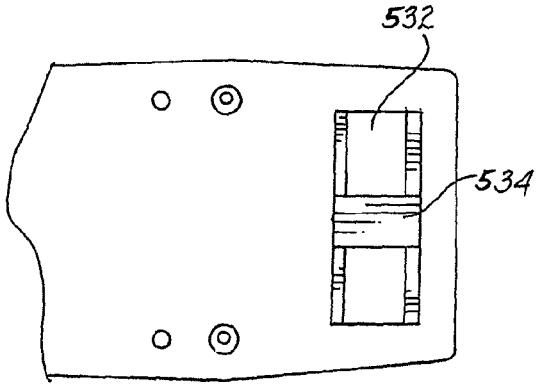
FIG. 26 shows a partial bottom view of the top section of the base plate used in the adjustable drum pedal depicted in FIG. 19.
Figure 38:
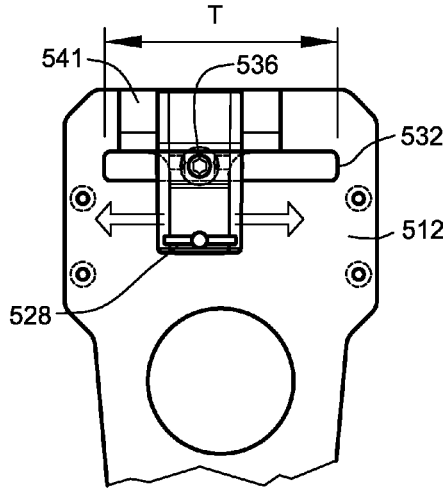
FIG. 38 shows a partial top view of a supporting base plate comprising a transverse slot in which a drum-clamping device is movably engaged, according to an alternate preferred embodiment of the present invention.

Base plate 512 preferably comprises second slot 532 (See also FIG. 26 and FIG. 38). Second slot 532 is preferably located on a top section of base plate 512. The second slot runs a majority of the width of base plate 512. Clamping device 528 is preferably designed so that clamping device 528 is preferably allowed to slide within second slot 532 in order to adjust the position of clamping device 528. In a preferred embodiment of the present invention, second slot 532 comprises a preferred transverse width T of about four inches, as best illustrated in FIG. 38. Clamping device 528 preferably comprises tab member 534, as shown. Tab member 534 is of a sufficient size to secure clamping device 528 within second slot 532 but still allow clamping device 528 to slide within second slot 532.

Clamping device 528 preferably comprises adjustment device 536, as shown. Adjustment device 536 is preferably used to lock clamping device 528 in position. By loosening adjustment device 536, the operator may preferably slide clamping device 528 within second slot 532 preferably in order to adjust the position of clamping device 528. When the operator has selected the proper position for base pedal 510, the operator preferably tightens adjustment device 536 to lock clamping device 528 in position. Preferably, by tightening clamping device 528, the operator will further secure foot pedal 510 to rim 531 of bass drum 530. By tightening adjustment device 536, a pair of skid resistant pads 540 will preferably contract around the rim 531 of bass drum 530 preferably securing foot pedal 510 to bass drum 530. Clamping device 528 preferably has a follower bar 541. Follower bar 541 preferably assists in locking clamping device 528 to the bottom of rim 531 of the bass drum 530. Follower bar 541 preferably comprises a skid resistant pad 540 to assist in securing foot pedal 510 to bass drum 530.

Figure 23:
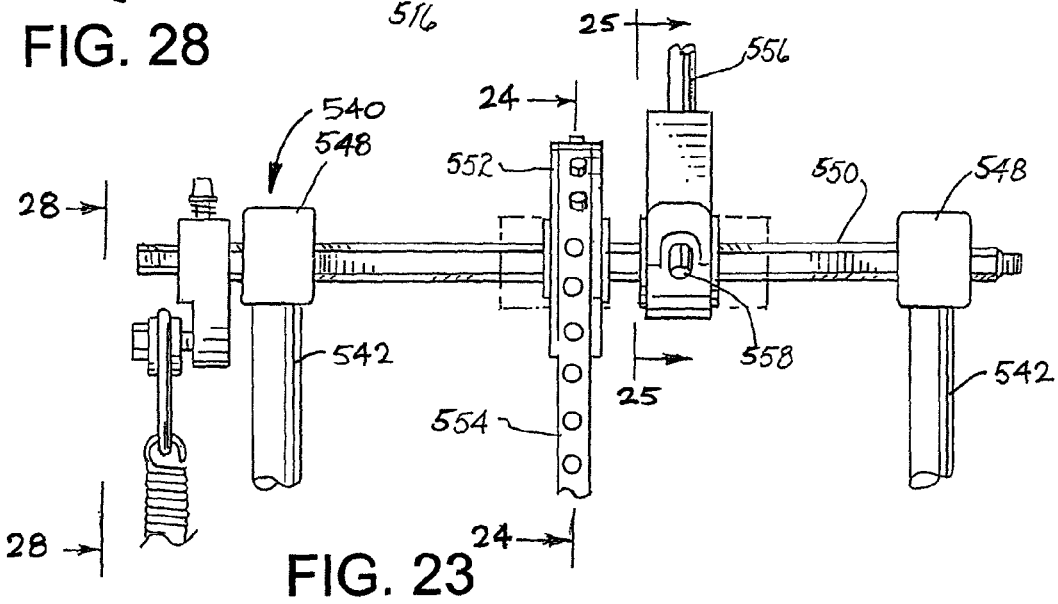
FIG. 23 shows a partial front view of the cam and beater mechanism of the adjustable drum pedal of FIG. 19.
Figure 27:
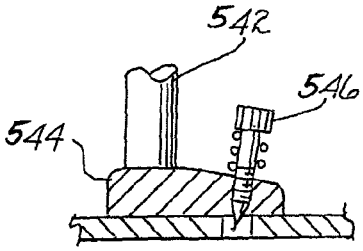
FIG. 27 is shows cross sectional side view of the support bars used in the adjustable drum pedal depicted in FIG. 19.

Referring now to FIG. 19 and FIG. 23, beater support assembly 540 is preferably coupled to base plate 512. Beater support assembly 540 is preferably comprised of a pair of vertical support columns 542. As seen more clearly in FIG. 27, one end of each vertical support column 542 is preferably coupled to a base member 544. Base member 544 is preferably coupled to the base plate 512 via coupling device 546. Coupling device 546 preferably comprises a screw, alternately preferably a peg, alternately preferably rivet, alternately preferably a similar fastener.

Preferably, on the opposing end of each vertical bar member 542 is loop member 548. Crossbar 550 is preferably inserted into each of the loop members 548. Crossbar 550 is preferably allowed to rotate within loop members 548 when a torque is applied to crossbar 550. A torque arm in the form of wheel mechanism 552 is preferably coupled to crossbar 550, as shown. Preferably, wheel mechanism 552 is further coupled to foot pedal 516 via at least one flexible linkage identified herein as belt 554. Belt 554 preferably comprises at least one metal chain, alternately preferably a rubber belt, alternately preferably a like element. When pressure is applied to foot pedal 516 and belt 554 (via wheel mechanism 552), a rotation of crossbar 550 preferably results. This preferably causes drum beater 556, which is also coupled to the crossbar 550, to strike bass drum 530.

Wheel mechanism 552 preferably comprises release mechanism 553. Release mechanism 553 preferably allows wheel mechanism 552 to slide on crossbar 550 and be placed at a user-selected position on crossbar 550. This feature preferably increases the adjustability of drum pedal 510. This is due to the fact that moving wheel mechanism 552 allows foot pedal 516 to move and pivot to a greater degree.

Figure 25:
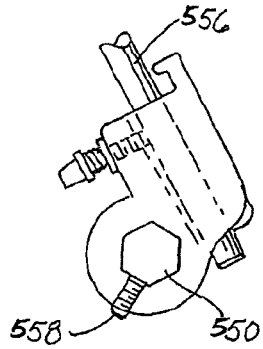
FIG. 25 shows a cross sectional side view of the beater mechanism used in the adjustable drum pedal taken along lines 25-25 of FIG. 23.

Referring now specifically to FIG. 25, as stated above, drum beater 556 is also preferably coupled to crossbar 550. A preferred feature of drum beater 556 is that drum beater 556 is movably coupled to cross bar 550. Drum beater 556 has a preferred release mechanism 558. Release mechanism 558 preferably allows drum beater 556 to slide along crossbar 550 and to be placed at substantially any user-selected position on crossbar 550. This preferably allows drum beater 556 to be placed to strike the center of the bass drum 530 regardless of the position of drum pedal 510. Furthermore, by moving drum beater 556, a user may preferably increase the adjustability of drum pedal 510. This is due to the fact that moving drum beater 556 allows foot pedal 516 to move and pivot to a greater degree.

Referring now to FIG. 19, FIG. 23, and FIG. 25, spring device 560 is preferably coupled to crossbar 550. Spring device 560 preferably comprises cam 562. Cam 562 is preferably coupled to crossbar 550. One end of spring 564 is preferably coupled to cam 562. The other end of the spring 564 is preferably coupled to base plate 512 or base member 544. Preferably, when pressure is applied to foot pedal 516, crossbar 550 rotates causing drum beater 556 to strike the bass drum. Preferably, when pressure is removed from foot pedal 516, spring device 560 returns crossbar 550 to its original position, drawing drum beater 550 back away from bass drum 530.

Figure 29:
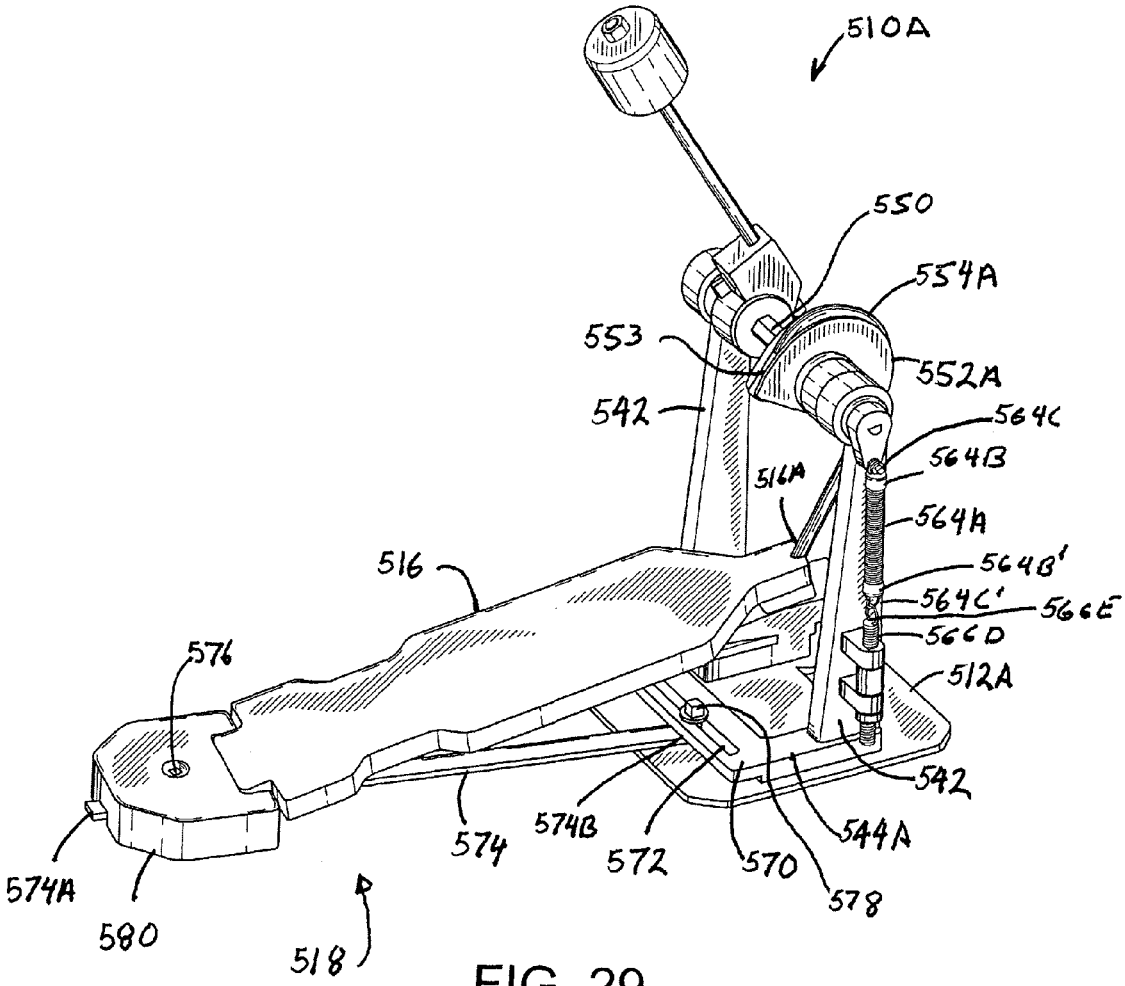
FIG. 29 shows an elevated perspective view of another embodiment of the adjustable drum pedal of the present invention.
Figure 30:
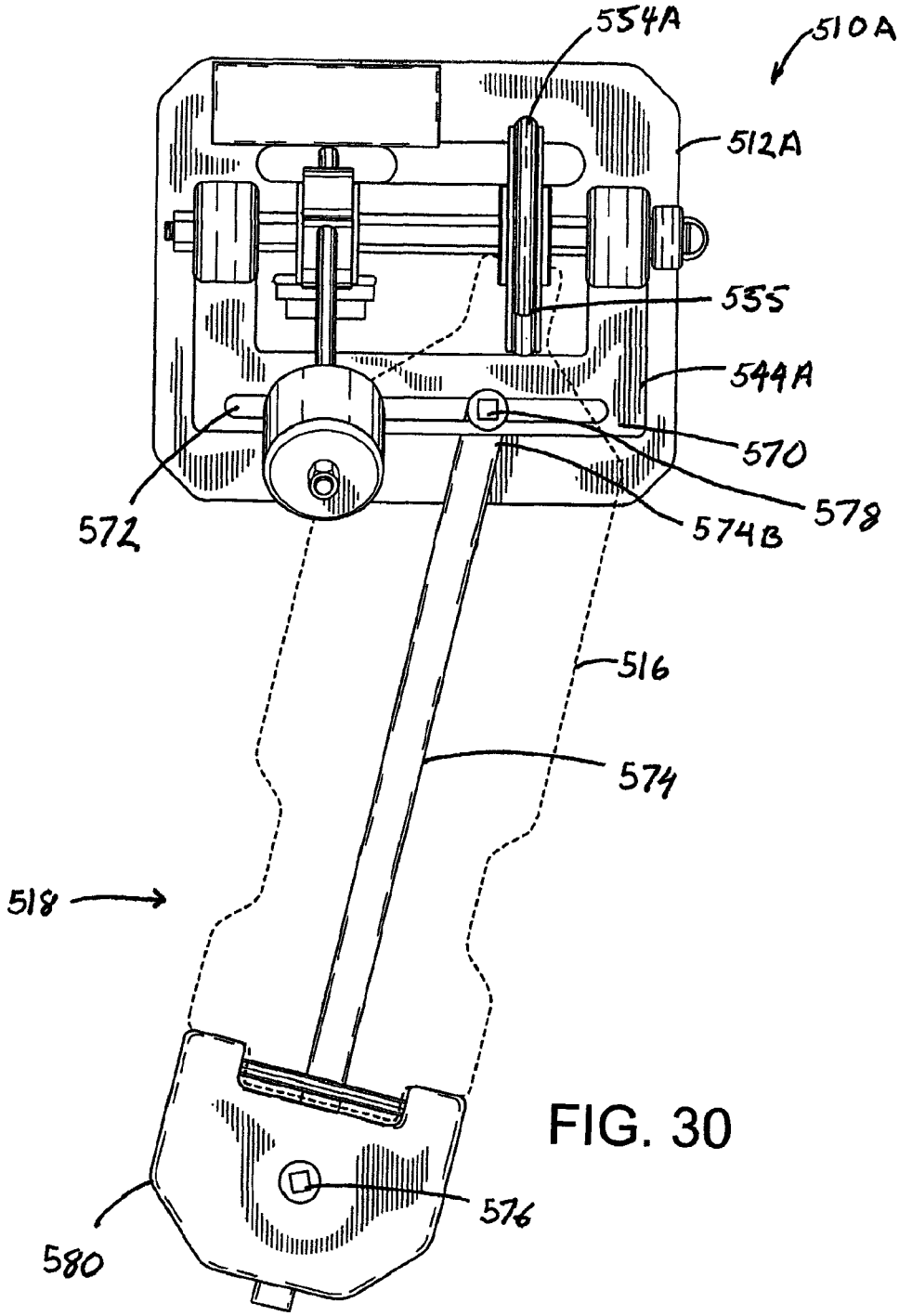
FIG. 30 shows an elevated perspective view of the embodiment of FIG. 29 with a section of the pedal removed.
Figure 31:
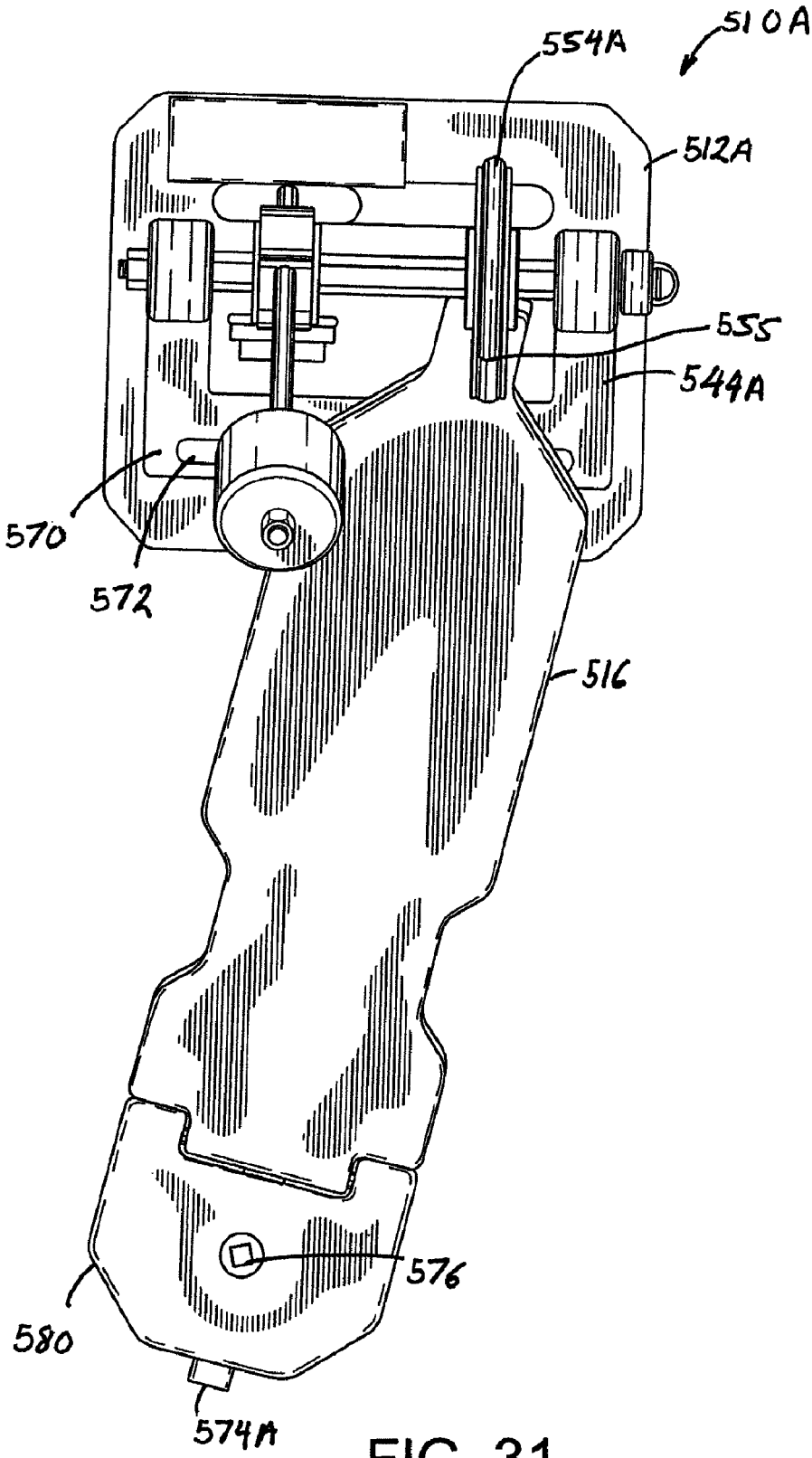
FIG. 31 shows a top view of the embodiment of FIG. 29.

Referring to FIG. 29 through FIG. 31, wherein like numerals and symbols represent like elements, another preferred embodiment of the present invention is shown. In this preferred embodiment, drum pedal 510A is substantially the same as that shown in FIGS. 19 through FIG. 28; thus, only the differences will be elaborated upon. One main difference is in base plate 512. Unlike the previous preferred embodiment of FIG. 19, base plate 512 is preferably rotatable.

In the preferred embodiment of FIG. 29 through FIG. 31, the full length base plate 512 has preferably been replaced with base plate 512A that preferably runs approximately a third of the length of foot pedal 516, as shown. Preferably, base member 544A has further been changed to have a transverse bar 570 coupled horizontally between vertical support columns 542, as shown. Support bar 570 is preferably coupled to vertical support columns 542 so as to be slightly raised above base plate 512A, as shown. Transverse bar 570 preferably comprises slot 572 that preferably runs a majority of the length of transverse bar 570 in a substantially horizontal manner, as shown.

Coupling mechanism 518 is still preferably used to movably couple foot pedal 516 to base plate 512A and to allow foot pedal 516 to pivot in a vertical manner. In the preferred embodiment depicted in FIG. 29 through FIG. 31, coupling mechanism 518 comprises foot pedal tab 580, as shown. A bottom surface of foot pedal tab 580 is preferably approximately planar with a bottom surface of base plate 512A. A non skid type of material is preferably placed on the bottom surface of foot pedal tab 580 to prevent foot pedal tab 580 from moving when the drum pedal 510A is being used. Preferably, foot pedal tab 580 is hingedly coupled to foot pedal 516A to allow foot pedal 516A to pivot in an up and down motion. Foot pedal tab 580 is preferably adjustably coupled to transverse bar 570 by bar-link member 574, as shown. Bar-link member 574 preferably comprises a first end 574A, which is secured to foot pedal tab 580 using attachment device 576, as shown. Attachment device 576 preferably comprises at least one mechanical fastener, preferably a screw, peg, rivet, or the like. The second end 574B of bar member 574 is preferably slidably coupled to transverse bar 570. Second end 574B is preferably coupled to slot 572 in transverse bar 570 using at least one coupling device 578, as shown. Second end 574B is preferably coupled to slot 572 in transverse bar 570 to allow the second end 574B of the bar member to slide in slot 572. Coupling device 578 preferably comprises a mechanical fastener such as a screw, peg, rivet, or similar item. It should be noted that the above listing should not be seen as to limit the scope of the present invention.

Bar-link member 574 preferably allows foot pedal 516 to both slide and pivot within slot 572. Thus, bar-link member 574 preferably allows the operator of the drum pedal 510A to quickly and easily adjust the position of the foot pedal 516 relative to the base plate 512A. The operator will then be able to comfortably place his/her foot completely on the foot pedal 516 no matter what size, shape or alignment problem he/she may have.

A second preferred difference from the prior embodiment is in the type of flexible linkage used with wheel mechanism 552A. As seen more clearly in FIG. 30 and FIG. 31, belt 554 is now preferably comprises more of a cord/rope 554A, as shown. Cord/rope 554A preferably uses a pair of end caps 555. End caps 555 are preferably used to couple cord/rope 554A to wheel mechanism 552A and foot pedal 516. As seen in FIG. 30 and FIG. 31, one end cap 555 is preferably used to secure cord/rope 554A to wheel mechanism 552A. A channel 553 is preferably formed in wheel mechanism 552A to hold cord/rope 554A in wheel mechanism 552A. Once cord/rope 554A is placed in channel 553, end cap 555 is preferably placed around cord/rode 554A and inserted into end 553A of channel 553.

Figure 32:
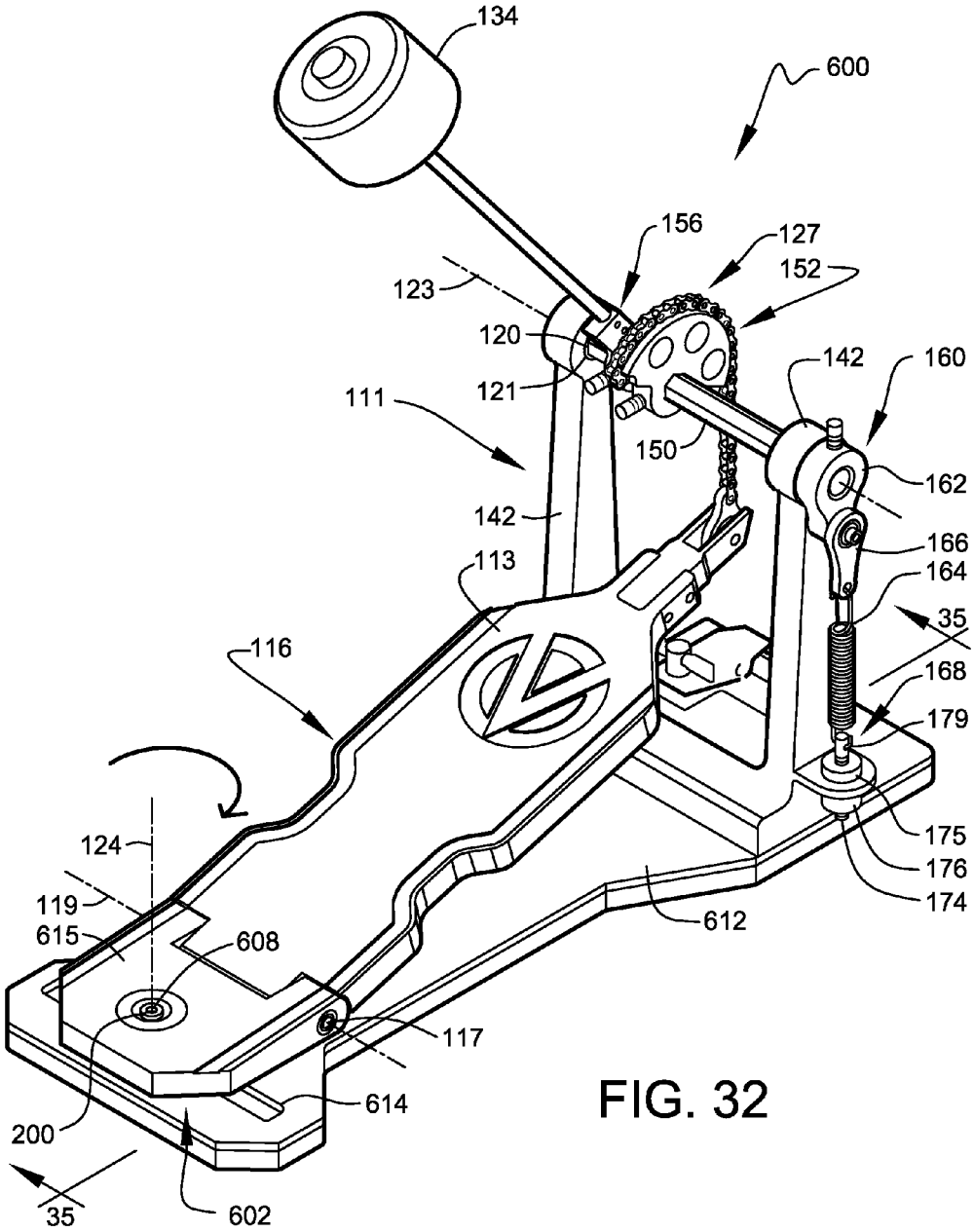
FIG. 32 shows a perspective view, showing an alternate user-adjustable drum pedal, according to a preferred embodiment of the present invention.
Figure 33:
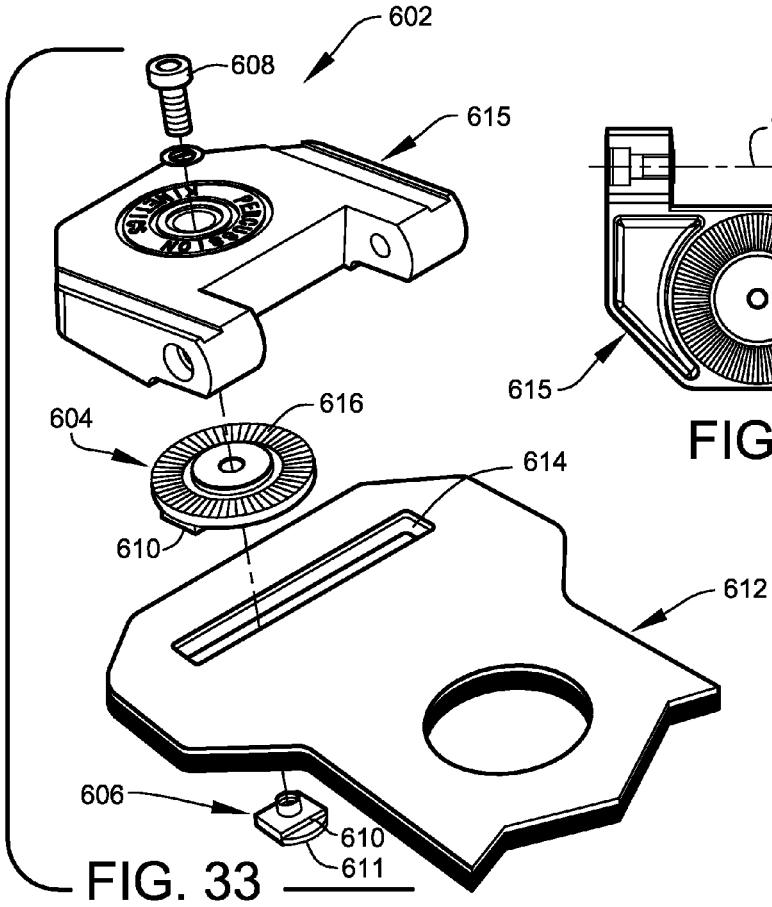
FIG. 33 shows a partial exploded view of a two-way adjustable heel pivot assembly, according to the preferred embodiment of FIG. 32.

The other end of cord/rope 554A is preferably coupled to foot pedal 516. Referring now to FIGS. 32 and 33, a channel 516A is preferably formed in a front bottom section 516B of foot pedal 516. Cord/rope 554A is preferably placed in channel 516A. The second end cap 555 is preferably placed on cord/rope 554A to secure cord/rope 554A in foot pedal 516.

The preferred use of cord/rope 554A preferably decreases the cost of drum pedal 510 and is easier to change out than belt 554. The use of channel 553 and channel 516A along with the end cap, assures that cord/rope 554A stays properly mounted.

Figure 34:
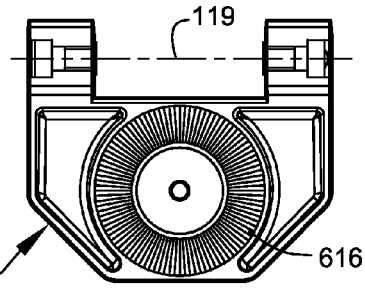
FIG. 34 shows a bottom view of an alternate heel-end portion, according to the preferred embodiment of FIG. 32.
Figure 35:
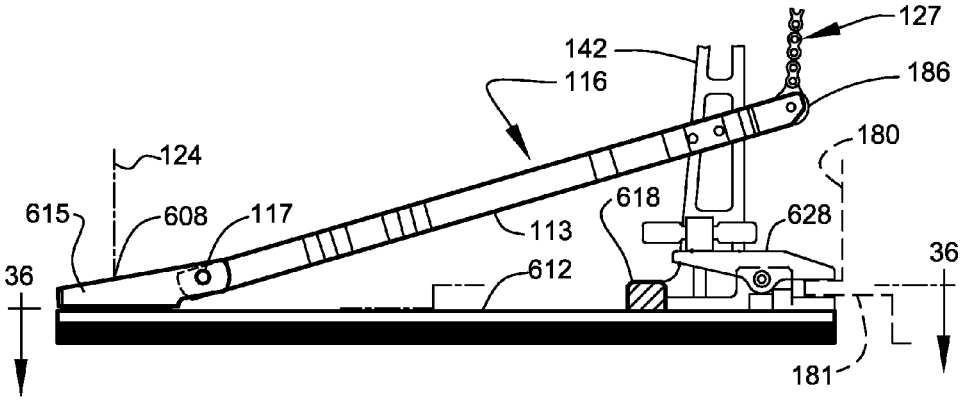
FIG. 35 shows a partial sectional view through the section 35-35 of FIG. 32.

Referring now to FIG. 34 and FIG. 35, spring device 564A has also been modified. Spring device 564A preferably has a first end cap 564B. Ring 564C is preferably coupled to end cap 564B. Ring 564C is then preferably mounted to crossbar 550. The other end of spring 564A preferably comprises a second end cap 564B' with ring 564C' preferably coupled thereto. Ring 564C' is preferably hingedly coupled to bar member 566D preferably via pin 566E. Bar member 566D is preferably coupled to a bottom section of the vertical support columns 542. Preferably, when pressure is applied to foot pedal 516, crossbar 550 rotates preferably causing drum beater 556 to strike the bass drum. Preferably, when pressure is removed from foot pedal 516, spring device 560 returns crossbar 550 to its original position drawing drum beater 550 back away from bass drum 530. The preferred use of the end caps 564B and 564B', rings 564C and 564C', and pin 566E assists in rotating spring 564A when foot pedal 516 is pressed. Rotation of spring 564A preferably allows for a smoother movement of foot pedal 516 when it is pressed downward and when it returns to its original resting position.

FIG. 32 shows a perspective view, showing alternate user-adjustable drum pedal 600, according to a preferred embodiment of the present invention. Alternate user-adjustable drum pedal 600 preferably combines the functions of the embodiment of FIG. 1 with an additional user adjustment at the heel portion of foot pedal 116. It is noted that alternate user-adjustable drum pedal 600 comprises physical arrangements substantially similar to the preferred embodiment of FIG. 1; thus, only the differences between alternate user-adjustable drum pedal 600 and the prior embodiment will be elaborated upon.

FIG. 33 shows a partial exploded view of a two-way adjustable heel pivot assembly 602, according to the preferred embodiment of FIG. 32. FIG. 34 shows a bottom view of alternate heel-end portion 615, according to the preferred embodiment of FIG. 32. Two-way adjustable heel pivot assembly 602 is preferably structured and arranged to both pivot about third rotational axis 124 and translate side-to-side in a direction substantially parallel with second axis of rotation 123 (at least embodying herein at least one first adjuster to assist adjustment of said at least one foot-actuatable pedal to at least one selected angular orientation, relative to the horizontal axis of rotation, by rotating at least one toe-end portion of said at least one foot pedal about at least one pivot point of at least one heel-end portion of said at least one foot-actuatable pedal, and at least one second adjuster to assist positional adjustment of said at least one foot-actuatable pedal relative to the horizontal axis of rotation). This allows the user even greater flexibility in adjusting the position of foot pedal 116 to an optimal position of comfort during playing.

Two-way adjustable heel pivot assembly 602 preferably comprises alternate heel-end portion 615, intermediate engager 604, threaded receiver 606, and locking fastener 608, as shown. Two-way adjustable heel pivot assembly 602 is preferably assembled by passing locking fastener 608 through alternate heel-end portion 615, intermediate engager 604, and linear slot 614 to engage threaded receiver 606. Both intermediate engager 604 and locking fastener 608 preferably comprise projecting guide elements 610 structured and arranged to slidably engage linear slot 614 formed within alternate base plate 612. Threaded receiver 606 also preferably comprises side extensions 611 adapted to block the passage of threaded receiver 606 through linear slot 614 when engaged therein.

Linear slot 614 preferably runs across a majority of the width of alternate base plate 612, as shown. Linear slot 614 is preferably oriented substantially parallel with second axis of rotation 123. Upon reading this specification, those with ordinary skill in the art will now appreciate that, under appropriate circumstances, considering such issues as cost, user preference, etc., other slot arrangements such as, for example, orienting a slot at an alternate angle, using a non-linear slot, etc., may suffice.

When engaged within linear slot 614, projecting guide elements 610 are preferably adapted to allow side-to-side translation of both intermediate engager 604 and threaded receiver 606 relative to alternate base plate 612; however, rotation of both intermediate engager 604 and threaded receiver 606 relative to alternate base plate 612 is preferably prevented.

The top of intermediate engager 604 and bottom of alternate heel-end portion 615 each preferably comprise a set of inter-engaging radial teeth 616 centrally disposed about locking fastener 608, as shown. Radial teeth 616 in the lower surface of alternate base plate 612 are preferably adapted to engage corresponding radial teeth 616 in the upper surface of intermediate engager 604 in order to prevent rotation of alternate heel-end portion 615 (and about third rotational axis 124). Such rotation or adjustment is however enabled preferably by loosening locking fastener 608 from threaded receiver 606 so that radial teeth 616 of alternate heel-end portion 615 can be rotated to engage alternative radial teeth 616 of intermediate engager 604. To make such adjustment readily executable by the user, locking fastener 608 (at least embodying herein at least one releasable lock to releasably lock said at least one foot-actuatable pedal in the at least one selected angular orientation, wherein such at least one toe-end portion, when locked, comprises a fixed geometrical relationship with said at least one rotatable support bar) preferably comprises a hex head threaded fastener preferably coupled with threaded receiver 606. Upon reading this specification, those with ordinary skill in the art will now appreciate that, under appropriate circumstances, considering such issues as cost, user preference, etc., other locking arrangements such as, for example, spring-loaded lift-and-place engagements, cam locks, wing-type nuts, friction devices, etc., may suffice.

Figure 36:
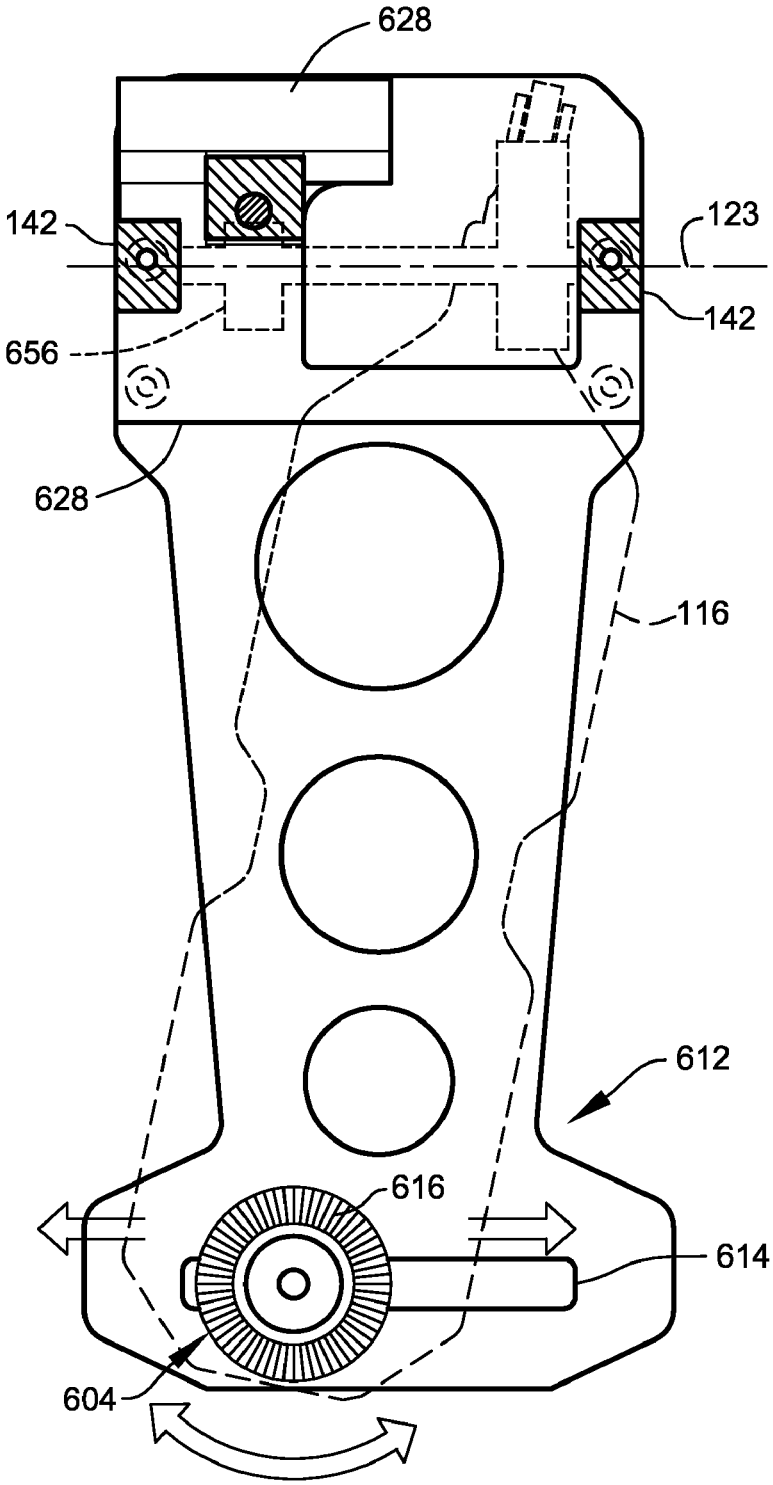
FIG. 36 shows a sectional view through the section 36-36 of FIG. 35.

FIG. 35 shows a partial sectional view through the section 35-35 of FIG. 32. FIG. 36 shows a sectional view through the section 36-36 of FIG. 35. In the preferred embodiment of FIG. 32, the assembly preferably allows about a two-inch side-to-side movement of locking fastener 608/third rotational axis 124 in a direction generally parallel to second axis of rotation 123.

In preferred embodiments of the present invention, including preferred variants of alternate user-adjustable drum pedal 600, the position of alternate clamping device 628 is fixed relative to the base plate (alternate base plate 612), as shown. For economy and strength, the lower portion of alternate clamping device 628 may be integrally cast with the base portion 618 of the support columns 142, as shown. In general, the operator mounts alternate clamping device 628 to the lowest point of rim 181 of bass drum 180. This preferred mounting position is intended to place the mallet of drum beater assembly 656 in an ideal position relative to the membrane of bass drum 180. In this preferred arrangement, drum beater assembly 656 may preferably comprise a fixed side-to-side mounted position on rotatable crossbar 262, preferably in approximate alignment with the attachment point of alternate clamping device on rim 181.

Figure 37:
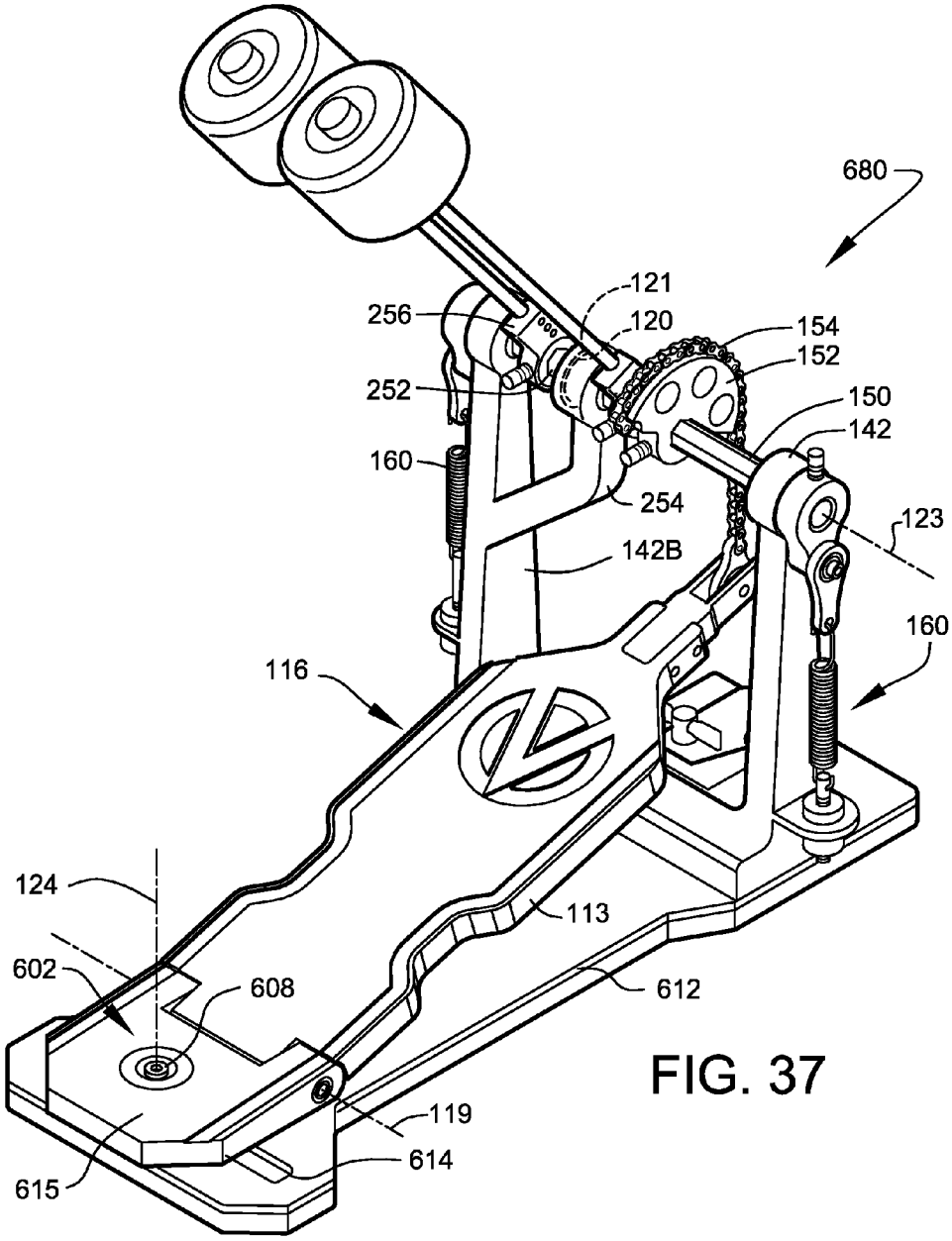
FIG. 37 shows a perspective view, showing an alternate double beater user-adjustable drum pedal, according to a preferred embodiment of the present invention.

FIG. 37 shows a perspective view, showing an alternate double-beater user-adjustable drum pedal 680, according to another preferred embodiment of the present invention. The alternate double-beater user-adjustable drum pedal 680 of FIG. 37 preferably combines the functions of the preferred embodiment of FIG. 15 with the additional user adjustment at the heel portion of foot pedal 116 described in alternate user-adjustable drum pedal 600 of FIG. 32. As with the prior-described embodiment, this preferably allows the user even greater flexibility in adjusting the position of foot pedal 116 to an optimal position of comfort during playing.

The alternate double-beater user-adjustable drum pedal 680 preferably comprises a two-way adjustable heel pivot assembly 602 substantially identical to that described for alternate user-adjustable drum pedal 600, preferably including an intermediate engager, a threaded receiver, and a locking fastener 608. Both the intermediate engager and the locking fastener preferably comprise projecting guide elements designed to engage linear slot 614 formed within alternate base plate 612. Linear slot 614 preferably runs across a majority of the width of alternate base plate 612, as shown. Linear slot 614 is preferably oriented to be substantially parallel with second axis of rotation 123. Although only two preferred embodiments of the present invention were illustrated utilizing the two-way adjustable heel pivot assembly, those with ordinary skill in the art will now appreciate that, under appropriate circumstances, considering such issues as cost, user preference, etc., the use of a two-way adjustable heel pivot in other preferred embodiments such as, for example, a single pedestal embodiment, etc., may suffice.

FIG. 38 shows a partial top view generally illustrating the alternate preferred supporting base plate 512 of FIG. 22 comprising the transverse second slot 532 in which a drum clamping device 528 is movably engaged.

Figure 39:
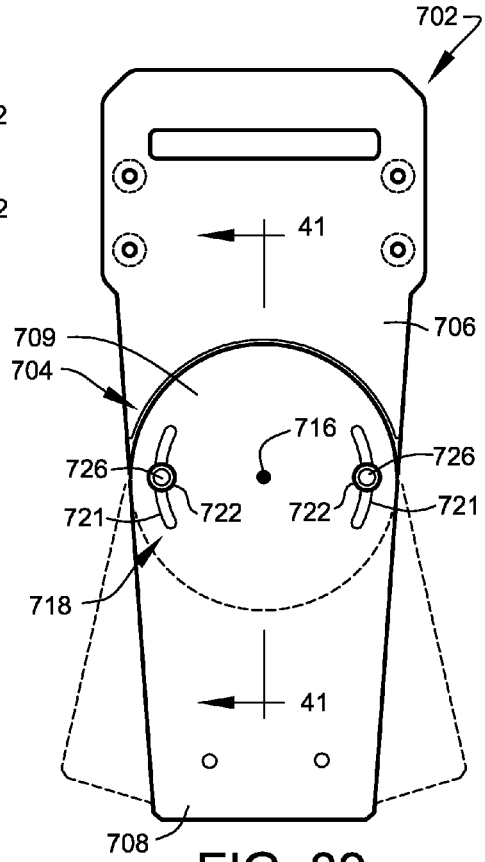
FIG. 39 shows a top view, in partial section, illustrating an alternate base plate, comprising a central pivot assembly, according to an alternate preferred embodiment of the present invention.
Figure 40:
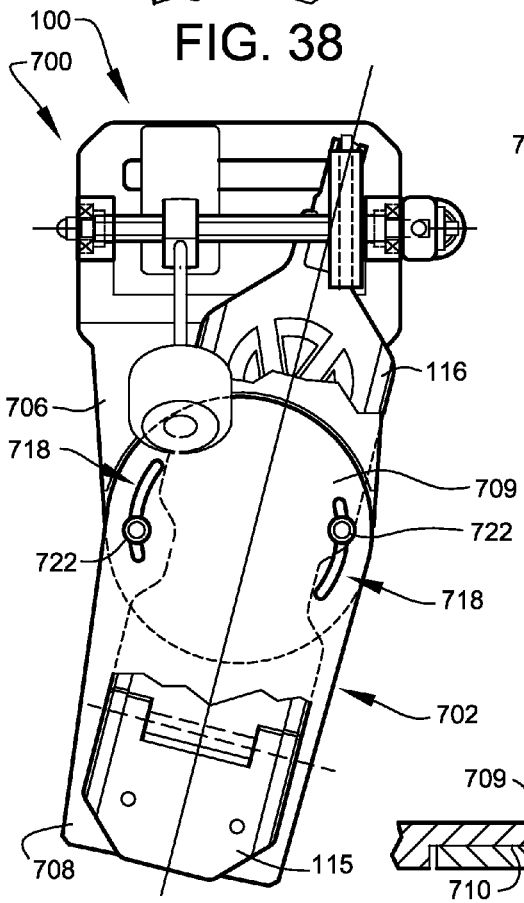
FIG. 40 shows a top view, in partial section, illustrating an alternate user-adjustable drum pedal utilizing the alternate base plate of FIG. 39.
Figure 41:
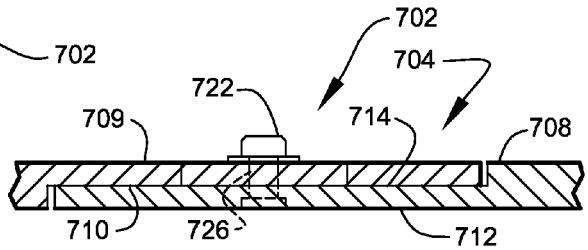
FIG. 41 is a sectional view through the section 41-41 of FIG. 40 illustrating the preferred arrangements of the central pivot assembly, according to the alternate base plate of FIG. 39.

FIG. 39 shows a top view, in partial section, illustrating an alternate base plate 702 comprising central pivot assembly 704, according to an alternate preferred embodiment of the present invention. FIG. 40 shows a top view, in partial section, illustrating alternate user-adjustable drum pedal 700 utilizing the alternate base plate 702 of FIG. 39. FIG. 41 is a sectional view through the section 41-41 of FIG. 40 illustrating the preferred arrangements of central pivot assembly 704, according to the alternate base plate 702 of FIG. 39. It is noted that alternate user-adjustable drum pedal 700 comprises physical arrangements substantially similar to the preferred embodiment of FIG. 1; thus, only the differences between alternate user-adjustable drum pedal 700 and the prior embodiment will be elaborated upon.

As in the prior embodiments, alternate user-adjustable drum pedal 700 is preferably designed to provide adjustability of pedal position to optimally orient the footboard with respect to the user's foot. Alternate base plate 702 is preferably divided into two sections identified herein as toe section 706 and heel section 708, as shown. Preferably, toe section 706 is pivotally coupled to heel section 708, at central pivot assembly 704, as shown.

Central pivot assembly 704 preferably comprises an articulatable joint having an upper half 709 joined with heel section 708 and a lower half 712 joined with toe section 706, as shown. Upper half 709 preferably comprises lower contact surface 710 preferably placed in contact with an upper contact surface 714 of lower half 712, as shown. Upper half 709 and lower half 712 are preferably formed to comprise complementary arcuate outer peripheral edges to facilitate rotation about a central point 716, as shown.

Heel-end portion 115 of foot pedal 116 is preferably fixed to heel section 708, as shown. Angular adjustment of foot pedal 116 is preferably accomplished by pivoting heel section 708 about central point 716, as shown. Foot pedal 116 is preferably fixed in the selected angular position by locking assembly 718. Locking assembly 718 preferably comprises a pair of threaded pins 726 fixed to lower half 712 and arranged to project upwardly through arcuate slots 721 formed within upper half 709, as shown. Threaded fasteners 722 are preferably engaged on threaded pins 726 and are tightened to frictionally engage lower contact surface 710 and upper contact surface 714. In this way, central pivot assembly 704 is lockable during use and unlockable for angular repositioning of foot pedal 116 by the user. Upon reading this specification, those with ordinary skill in the art will now appreciate that, under appropriate circumstances, considering such issues as cost, user preference, etc., other arrangements such as, for example, providing additional frictional enhancements, additional adjustment slots, relocating the pivot point forward or back, etc., may suffice.

Although applicant has described applicant's preferred embodiments of this invention, it preferably be understood that the broadest scope of this invention includes modifications such as diverse shapes, sizes, and materials. Such scope is limited only by the below claims as read in connection with the above specification. Further, many other advantages of applicant's invention preferably be apparent to those skilled in the art from the above descriptions and the below claims.

What is claimed is:

1. A drum-pedal system related to foot-actuated playing of at least one drum by at least one drum player, said drum-pedal system comprising, in combination:

a) at least one foot pedal, having at least one toe-end portion and at least one heel-end portion, said at least one foot pedal structured and arranged to receive at least one foot of the at least one drum player;

b) at least one hinge structured and arranged to hingedly couple said at least one heel-end portion with said at least one toe-end portion to enable up-and-down movement of said at least one toe-end portion about at least one first rotational axis;

c) at least one rotatable support bar structured and arranged to provide rotatable-bar support about at least one second rotational axis;

d) at least one positioning frame structured and arranged to position said at least one rotatable support bar adjacent said at least one toe-end portion;

e) a pivot structured and arranged to provide side-to-side pivoting of said at least one toe-end portion about a third rotational axis intersecting said at least one heel-end portion and oriented substantially perpendicular to such at least one first rotational axis;

f) coupled with said at least one rotatable support bar, at least one drum-striker structured and arranged to strike the at least one drum on rotation of said at least one rotatable support bar;

g) at least one bar rotator structured and arranged to rotate said at least one rotatable support bar when pressure is applied to said at least one toe-end portion; and h) at least one striker-return assembly structured and arranged to return said at least one drum-striker to at least one starting position when pressure is removed from the at least one foot pedal;

i) wherein said at least one bar rotator is mounted to said at least one rotatable support bar to allow lateral movement of said at least one bar rotator, in at least one direction substantially parallel with said at least one second rotational axis, in coordination with such side-to-side pivoting of said at least one toe-end portion about such third rotational axis;

j) wherein said at least one bar rotator comprises i) releasably coupled to said at least one rotatable support bar, at least one torque arm structured and arranged to induce a rotation of said at least one first rotatable support bar by the application of at least one torque-arm force, and ii) at least one linkage structured and arranged to operably link said at least one torque arm with said at least one toe-end portion;

k) wherein said at least one torque arm comprises at least one lateral adjuster structured and arranged allow lateral adjustment to the position of at least one torque arm, in at least one direction substantially parallel with said at least one second rotational axis;

l) wherein said at least one linkage comprises i) at least one first coupler structured and arrange to couple a first end portion of said at least one linkage to said at least one toe-end portion, and ii) at least one second coupler structured and arrange couple a second end portion of said at least one linkage to said at least one torque arm; and m) wherein said at least one first coupler comprises at least one spherical bearing structured and arranged to permit angular rotation of said at least one linkage about at least one central connection point.

2. The drum-pedal system according to claim 1 wherein the position of said pivot relative to said at least one positioning frame is at least adjustable along at least one line oriented substantially parallel with said at least one second rotational axis.

3. The drum-pedal system according to claim 1 wherein the location of said pivot is fixed relative to said at least one positioning frame.

4. The drum-pedal system according to claim 1 wherein said at least one positioning frame comprises at least one coupling device structured and arranged to couple said at least one positioning frame to the at least one drum.

5. The drum-pedal system according to claim 4 wherein said at least one coupling device comprises at least one clamping device structured and arranged to provide clamp-assisted coupling of said at least one positioning frame to the at least one drum.

6. The drum-pedal system according to claim 5 wherein said at least one drum-striker and said at least one clamping device are each alignable to at least one position of intersection with a substantially vertical plane passing through said pivot and oriented substantially perpendicular to said at least one second rotational axis.

7. The drum-pedal system according to claim 5 wherein:

i) the relative positions of said at least one drum-striker, said at least one clamping device, and said pivot are positionally fixed within said at least one positioning frame; and ii) said at least one drum-striker, said at least one clamping device, and said pivot are each geometrically aligned to intersect a substantially vertical plane oriented substantially perpendicular to said at least one second rotational axis.

8. The drum-pedal system according to claim 5 wherein said at least one positioning frame comprises at least one base support structured and arranged to support said at least one positioning frame on at least one supportive surface.

9. The drum-pedal system according to claim 1 wherein said at least one first striker-return assembly comprises at least one spring structured and arranged to generate at least one biasing force having at least one first end coupled with said at least one positioning frame and at least one second end eccentrically coupled with said at least one rotatable support bar.

10. The drum-pedal system according to claim 1 wherein said at least one positioning frame further comprises projecting generally upwardly from said at least one base support, a single support column structured and arranged to support said at least one first rotatable support bar in at least one substantially horizontal position adjacent said at least one toe-end portion.

11. The drum-pedal system according to claim 1 wherein said at least one positioning frame further comprises:

i) projecting generally upwardly from said at least one base support, a single support column structured and arranged to support said at least one first rotatable support bar in at least one substantially horizontal position at an elevation above said at least one toe-end portion;

ii) wherein said single support column comprises at least one friction-reducing bearing structured and arranged to provide reduced-friction rotation of said at least one first rotatable support bar during such support;

iii) wherein said at least one first rotatable support bar is arranged to passes through said single support column;

iv) wherein said at least one drum-striker is mounted to said at least one first rotatable support bar on a first side of said single support column; and v) wherein said at least one torque arm is mounted to said at least one first rotatable support bar on a second side of said single support column.

12. The drum-pedal system according to claim 1 wherein said at least one positioning frame further comprises:

i) projecting generally upwardly from said at least one base support, at least two support columns structured and arranged to support said at least one first rotatable support bar in at least one substantially horizontal position at an elevation above said at least one toe-end portion;

ii) wherein each said at least two support columns comprise at least one friction-reducing bearing structured and arranged to provide reduced-friction rotation of said at least one first rotatable support bar during such support.

13. The drum-pedal system according to claim 12 further comprising:

i) at least one additional rotatable support bar structured and arranged to provide rotatable-bar support about said at least one second rotational axis;

ii) coupled with said at least one additional rotatable support bar at least one additional drum-striker structured and arranged to be independently actuatable by at least one additional rotation-generating torque force; and iii) at least one additional striker-return assembly structured and arranged to return said at least one additional drum-striker to at least one starting position when such at least one additional rotation-generating torque force is removed from said at least one additional rotatable support bar;

iv) wherein said at least one bar rotator is positioned to the right of said at least one drum-striker and said at least one additional drum-striker, as oriented relative to the foot of a user during operation.

14. The drum-pedal system according to claim 13 further comprising:

i) at least one additional foot-actuated pedal assembly structured and arranged to generate such at least one additional rotation-generating torque force when pressure is applied to at least one additional foot pedal of said at least one additional foot-actuated pedal assembly; and ii) at least one force-transfer linkage structured and arranged to transfer such at least one additional rotation-generating torque force to said at least one additional rotatable support bar.

15. The drum-pedal system according to claim 14 wherein said at least one force-transfer linkage comprises at least one angular adjuster structured and arranged to allow user-selected angular adjustments of said at least one additional foot-actuated pedal relative to said at least one additional rotatable support bar.

16. An adjustable drum pedal comprising, in combination:

i) at least one foot pedal;

ii) at least one base plate;

iii) at least one frame coupled to said at least one base plate;

iv) at least one transverse bar, having at least one slot running at least one length of said at least one transverse bar, said at least one transverse bar coupled to said at least one frame and raised above said at least one base plate;

v) at least one drum-beater mechanism movably coupled to said at least one frame to allow at least one user to adjust at least one position of said at least one drum-beater mechanism on said at least one frame;

vi) at least one drive assembly movably coupled to said at least one drum-beater mechanism and said at least one foot pedal structured and arranged to move said at least one drum-beater mechanism when pressure is applied to said at least one foot pedal and return said at least one drum-beater mechanism to at least one starting position when such pressure is removed from said at least one foot pedal; and vii) at least one adjustment device, having at least one first end coupled to said at least one foot pedal and at least one second end slidably coupled in said at least one slot of said at least one transverse bar to assist adjusting at least one position of said at least one foot pedal relative to said at least one base plate.

17. The adjustable drum pedal according to claim 16 wherein said at least one adjustment device comprises:

i) at least one foot-pedal tab hingedly coupled to said at least one foot pedal structured and arranged to allow said at least one foot pedal to pivot in a substantially up-and-down motion; and ii) at least one bar-link member having at least one first end coupled to said at least one foot pedal tab and at least one second end slidably coupled in said at least one slot of said at least one bar.

18. The adjustable drum pedal according to claim 16 further comprising:

i) at least one clamping device movably coupled to said at least one base plate structured and arranged to allow the at least one user to couple said at least one adjustable drum pedal in multiple positions relative to at least one drum;

ii) at least one second slot running along at least one width of at least one top section of said at least one base plate; and iii) at least one clamping-device adjustment mechanism, positioned in said at least one second slot and coupled to said at least one clamping device, structured and arranged to allow said at least one clamping device to move laterally within said at least one second slot.

19. The adjustable drum pedal according to claim 18 wherein said at least one frame comprises:

i) at least one pair of support columns;

ii) base members coupled to said at least one base plate and said at least one pair of support columns to couple said at least one pair of support columns to said base plate; and iii) at least one cross bar rotatably coupled to at least one support column of said at least one pair of support columns.

20. The adjustable drum pedal according to claim 19 wherein said at least one drive assembly comprises:

i) at least one wheel device movably coupled to said at least one cross bar;

ii) at least one flexible linkage coupled to said at least one wheel device and to said at least one foot pedal; and iii) end couplers coupled to at least one first end and at least one second end of said at least one flexible linkage to secure said at least one flexible linkage to said at least one wheel device and said at least one foot pedal.

21. The adjustable drum pedal according to claim 20 wherein:

i) said at least one wheel device comprises at least one channel, said at least one flexible linkage positioned to rest in said at least one channel, one of said at least one end couplers coupling said at least one flexible linkage to said at least one channel in said at least one wheel device; and ii) at least one spring device structured and arranged to return said at least one drum-beater mechanism to at least one starting position when pressure is removed from said at least one foot pedal.

22. The adjustable drum pedal according to claim 20 wherein said at least one base plate is shorter than said at least one foot pedal.

* * * * *

UNITED STATES PATENT AND TRADEMARK OFFICE

CERTIFICATE OF CORRECTION

PATENT NO. : 8,063,293 B1
APPLICATION NO. : 12/545792
DATED : November 22, 2011
INVENTOR(S) : Kjellgren It is certified that error appears in the above-identified patent and that said Letters Patent is hereby corrected as shown below:

Column 26, Claim 1, line 41, “arranged allow” should read --arranged to allow--
Column 26, Claim 1, line 46, “arrange” should read --arranged--
Column 26, Claim 1, line 49, “arrange” should read --arranged--
Column 27, Claim 11, line 52, “passes” should read --pass--

Signed and Sealed this
Fifteenth Day of May, 2012

David J. Kappos

David J. Kappos
*Director of the United States Patent and Trademark Office*